US006036055A

United States Patent [19]

Mogadam et al.

[11] Patent Number: 6,036,055

[45] Date of Patent: Mar. 14, 2000

[54] WIRELESS LIQUID PORTION AND INVENTORY CONTROL SYSTEM

[75] Inventors: Masoud M. Mogadam, San Francisco; Timothy J. Pracher, Palo Alto, both of Calif.

[73] Assignee: Barmate Corporation, San Francisco, Calif.

[21] Appl. No.: 08/960,154

[22] Filed: Oct. 29, 1997

Related U.S. Application Data

[60] Provisional application No. 60/030,872, Nov. 12, 1996.

[51] Int. Cl.[7] ..... B67D 5/06; B67D 5/22; B65D 5/72

[52] U.S. Cl. ..... 222/23; 222/28; 222/1; 222/30; 222/36; 222/567

[58] Field of Search ..... 222/1, 28, 30, 222/36, 641, 566, 567, 23

[56] References Cited

U.S. PATENT DOCUMENTS 3,170,597 2/1965 Reichenberger ..... 222/36
3,920,149 11/1975 Fortino et al. ..... 222/1
4,278,186 7/1981 Williamson ..... 222/36
5,255,819 10/1993 Peckels ..... 222/1

*Primary Examiner*—Andres Kashnikow
*Assistant Examiner*—Keats Quinalty
*Attorney, Agent, or Firm*—Carr & Ferrell LLP

[57] ABSTRACT

A system for controlling an amount of liquid poured from a liquid container includes a spout configured for attachment to an opening of a liquid container and for controlling a desired amount of liquid poured from the liquid container. The spout is further configured to emit signals containing activity information. A receiver is configured to receive the signals, and a computer is coupled to the receiver, for processing the signals into text for viewing. The present invention further provides a method of controlling liquid flow from a liquid container, including the steps of: (a) determining an amount of liquid which is to be poured from a liquid container; (b) transmitting activity information signal corresponding to a predetermined activity; (c) remotely receiving the activity information signal of step (b); and (d) processing the activity information signal of step (c) into readable form.

41 Claims, 15 Drawing Sheets

535
1800
UHF Antenna
P3 ANT
1A
1B
2A
2B
OPTIONAL
1805
C12 1pF
1810
C13 2.0–4.0μF
1815
C8 12pF
1885
C7 1pF
C14 3pF
1825
C17 12pF
1820
1890
R1 17K
R1
1880
1835
Q2
X1 300MHz
1830
1840
R10 10K NL
R12 10K
C9 100pF
1845
1850
1855
R11 10K
1860
C1 0.1μF
1865
C6 1μF
1870
R9 10K
C4 0.01μF
1875
VBATT
RADIO DATA
VRAD
C1 1μF
Q1 B55842X
R5 47K
VBATT
R3 4.7K
VBATT
GND
RADIO ON

WIRELESS LIQUID PORTION AND INVENTORY CONTROL SYSTEM

REFERENCE TO PRIOR CO-PENDING APPLICATIONS TO CLAIM PRIORITY

This application claims priority in Provisional Application Ser. No. 60/030,872, to M. Mogadam, filed on Nov. 12, 1996, and entitled "Poured Liquid Controller And Remote Inventory System." This application also claims priority in co-pending U.S. Design Patent Application Ser. No. 29/055,055, to M. Mogadam, filed on May 30, 1996, and entitled "Automated Beverage Dispenser." All of the foregoing prior co-pending patent applications (i.e., patent applications having Ser. Nos. 60/030,872 and 29/055,055) are fully incorporated herein by reference thereto as if repeated verbatim immediately hereinafter.

BACKGROUND OF THE INVENTION

1. Field of the Invention

The present invention relates generally to flow control devices and more specifically to a wireless system for controlling the amount of poured liquids (including liquors) and registering this information to a remote computer system.

2. Description of the Background Art

It is well known that the dispensing of expensive liquids such as liquor must be carefully monitored to avoid waste and loss. The management of establishments such as bars and taverns have long found it necessary to carefully monitor the relationship between liquor dispensed and receipts by controlling the quantity of liquor dispensed from a specific bottle and recording the sale.

Two types of products are presently in commercial use for measuring and recording dispensed liquor. The most established of the two products is the "liquor gun," which includes a hand held dispenser that attaches through a hose network to one or more liquor bottles. The bottles are typically stored in a cabinet under the bar, and the bartender delivers the beverage by pressing an appropriate button on the gun. Shots of the liquor are then automatically measured and delivered from the gun. Although widely used throughout the beverage industry, one major disadvantage of the gun is that the customer does not see the bottle as the liquor is being poured. In addition, since liquors from a plurality of bottles are delivered through the same nozzle, the taste of a particular liquor being delivered is affected. Since many name-brand liquors are sold at a premium, the fact that the bottle is hidden presents a product delivery problem for the tavern owner.

A second type of device used for liquor dispensing is the hard-wired donut-shaped "spout actuator" shown and described in U.S. Pat. No. 3,920,149 to Fortino et al. U.S. Pat. No. 3,920,149 is fully incorporated herein by reference thereto as if repeated verbatim immediately hereinafter. Taverns using the spout actuator equip each of their bottles with a plurality of spouts having unique magnetic bands. To pour a drink, the bartender inserts the spout of the bottle inside the spout actuator, which is wired to a metal box counter/power supply. The bartender then inverts the bottle and the spout actuator and pours a certain shot size specified by the customer. The metal box counter/power supply records the drink delivery. The disadvantage of the spout actuator technology is that only one drink can be poured at a time, and the bartender is tethered to the location of the metal box counter/power supply. Also, since there is a limitation on the magnetic band configuration on the spouts, only a few categories can be established, and brand identity for every individual spout is impossible. This analog system further lacks the flexibility and unlimited configuration capabilities of digital technology.

Although not commercially available, wireless systems for controlling and dispensing liquor have also been described in other issued patents. U.S. Pat. No. 3,170,597 describes a locking bottle spout having a radio transmitter which sends out a time-based signal, as liquid from the bottle is being dispensed. A receiving unit measures the duration of the pour and records the amount of liquor sold. U.S. Pat. No. 3,170,597 is fully incorporated herein by reference thereto as if repeated verbatim immediately hereinafter.

U.S. Pat. No. 4,278,186 to Williamson discloses a wireless pour spout which incorporates a pour-control mechanism into the spout head. U.S. Pat. No. 4,278,186 is fully incorporated herein by reference thereto as if repeated verbatim immediately hereinafter. A ball bearing is held by an electromagnet for a period sufficiently long so that a predetermined amount of liquid can be poured through the spout. Once the pour period is completed, the electromagnet holding the ball bearing is de-energized and the ball bearing drops into the pour channel and stops flow of the liquid. When the bottle is turned upright into its storage position, the ball bearing rolls back into the channel and again blocks the channel. One problem with this design is that the ball bearing pour seal can be avoided by tilting the bottle in a sideways direction so that the bearing does not fully stop the flow or by shaking the bottle while pouring and thus jarring the bearing out of the channel. Furthermore, the bearing does not provide much of a seal on the liquor when the bottle is in storage. Alcohol has a high vapor pressure and, if not stored in a tightly sealed container or where the pore channel is normally closed, the alcohol will evaporate over time. This evaporation not only results in lost product, but may also change the chemistry of liquors and mixtures such as Irish cream, as the alcohol flashes off leaving the heavier components behind. A more serious effect of a poor seal is that oxygen enters the bottle and degrades the liquor quality, particularly if the liquor contains high sugar content. These problems result with normally open outlets or channels versus normally closed channels.

Additionally, the pour spout of Williamson in U.S. Pat. No. 4,278,186 uses a transceiver and not a transmitter. The use of a transceiver leads to higher production and other costs. Furthermore, the pour spout of Williamson does not incorporate a modular design that would address proper charging of batteries and maintenance and cleaning of his disclosed pour spout in order to avoid damaging the power supply and the electronic circuitry module in the spout (see Williamson, column 3, lines 58–62, and column 7, line 64). In addition, the cap removal switch of Williamson's spout would not work on different sizes and shapes of bottles and will certainly be damaged during the vigorous engagement/disengagment of the cap from the bottles.

U.S. Pat. No. 5,255,819 to Peckels also discloses a pour spout with a pour-control mechanism. However, the pour spout of Peckels has the same disadvantages and problems of the spout of Williamson. U.S. Pat. No. 5,255,819 is fully incorporated herein by reference thereto as if repeated verbatim immediately hereinafter.

A further problem not addressed by conventional liquor dispensing systems is the difficulty of cleaning and maintaining the valve components after use. Because of the combination of mechanical and electronic parts, automated pour spouts are inherently difficult to clean. The mechanical flow components of the prior art are surrounded by electronics' and are not well suited for submersion in soapy water or for cleaning in an automated dishwater. Since rechargeable batteries require a venting mechanism, it is not commercially practical to build a waterproof pour spout containing hermetically-sealed rechargeable batteries. Even if such a sealed system were practical, heating the system in a 90 degree centigrade dishwasher would certainly not be conducive to long battery life, and may produce a dangerous result such as the explosion of the battery. It is also difficult to obtain Food and Drug Administration (FDA) approval for such a configuration, specifically when a toxic substance contained in a battery can possibly come in contact with the liquid to be consumed. Furthermore, since many liquors are syrupy and may leave behind dried residues when stored, thorough cleaning is necessary. The complex, single piece pour spouts provided by the above-mentioned patents are not well suited for cleaning, and recharging, and are difficult to maintain.

Thus, what is needed is a poured liquid controller and inventory system which enables measured distribution of liquids such as liquor and which is easy to use, clean and maintain.

SUMMARY OF THE INVENTION

The present invention provides a system for controlling an amount of liquid poured from a liquid container. The system includes a spout configured for attachment to an opening of a liquid container and for controlling a desired amount of liquid poured from the liquid container. The spout is further configured to emit radio signals containing activity information. A receiver is configured to receive the signals, and a computer is coupled to the receiver, for processing the signals into text for viewing. Software is installed in the computer for processing the received signals. The computer and software performs manipulation of data to provide detailed time/date activity information such as liquid sales and poured amounts, concerning each individual spout. The end result essentially can provide detailed journals reflecting total sales, as well as liquid poured/dispensed, spout engage/disengage activities and remaining quantity of liquid from each bottle.

The present invention further provides a system for enabling measured distribution and inventory of poured liquids. The system comprises an interface which is adapted for connection to an opening of a liquid-containing receptacle. The interface is also adapted for controlling the flow of liquid from the receptacle, and is configured to transmit signals containing activity information. A receiver receives the signals transmitted by the interface.

The immediate foregoing system further includes a data processing unit coupled to the receiver, processes the signals into readable form. The system also includes a valve chamber which is coupled to the interface for passing liquid out of the receptacle. A plunger seat is part of the chamber and seats the plunger. A plunger is biased to seal the valve at the plunger seat.

The interface includes a control mechanism for attracting the plunger away from the plunger seat at a predetermined time until the desired amount of liquid has passed through the valve and out of the receptacle.

The inner core assembly may be disengaged from the electronic shell assembly, and placed into a cleaning system such as a dishwasher. After washing, the inner core assembly may be re-connected to the electronic shell assembly to form the head and engaged to a bottle for controlling and monitoring the pouring or liquids.

The present invention further provides a method for controlling liquid flow from a liquid container, including the steps of:

(a) determining an amount of liquid which is to be poured from a liquid container;

(b) emitting activity information signal corresponding to a predetermined activity;

(c) remotely receiving the activity information signal of step (b); and (d) processing the activity information signal of step (c) into readable form. A computer and software are used for manipulation of the activity information into data.

In another embodiment of the method for controlling liquid flow from a liquid container, there is provided the method as including the following steps:

(a) engaging a spout to an opening of a liquid container to transmit a first signal and to control liquid flow;

(b) determining an amount of liquid which is to be poured from the liquid container;

(c) transmitting a second signal to a remote receiver after an amount of liquid has been poured from the liquid container; and (d) manipulating the second signal into readable form for viewing.

The immediate foregoing method may further include the steps of:

(e) disengaging the spout from the opening of the liquid container to transmit a third signal; and (f) disassembling the spout into an outer electronic shell and an inner valve core such that the outer electronic shell is available for recharging and the inner valve core is available for cleaning.

In yet another embodiment of the foregoing method of controlling an amount of liquid poured from a liquid container, there is provided the method as including the following steps:

(a) controlling an amount of liquid which is poured from a liquid container; and (b) emitting activity information signal corresponding to a predetermined activity.

The present invention permits flexibility to accommodate desired needs in the fast-paced bar business. For example, if a particular inner core assembly of an electronic shell assembly requires cleaning, that particular inner core assembly can be simply replaced with a spare inner core assembly. Thus the bartender can continue to use the system to control the distribution of poured liquid. Similarly, if a particular electronic shell assembly which is being used runs low in battery power, the bartender can simply disengage the low-power electronic shell assembly from the inner core assembly, replace it with a fully charged one and incorporate the new serial number of the new shell via Windows™ based software. The bartender can mount the previous low-power electronic shell assembly on the charger for recharging. Thus, assemblies are interchangeable to accommodate continuous needs of a bar, without having to lose or maintain an entire head (spout) and cause inefficiencies at the bar during bar hours.

DETAILED DESCRIPTION OF PREFERRED EMBODIMENTS OF THE INVENTION

Those of ordinary skill in the art will realize that the following description of the present invention is illustrative only and not in any way limiting. Other embodiments of the invention will readily suggest themselves to those skilled in the art.

Figure 1:
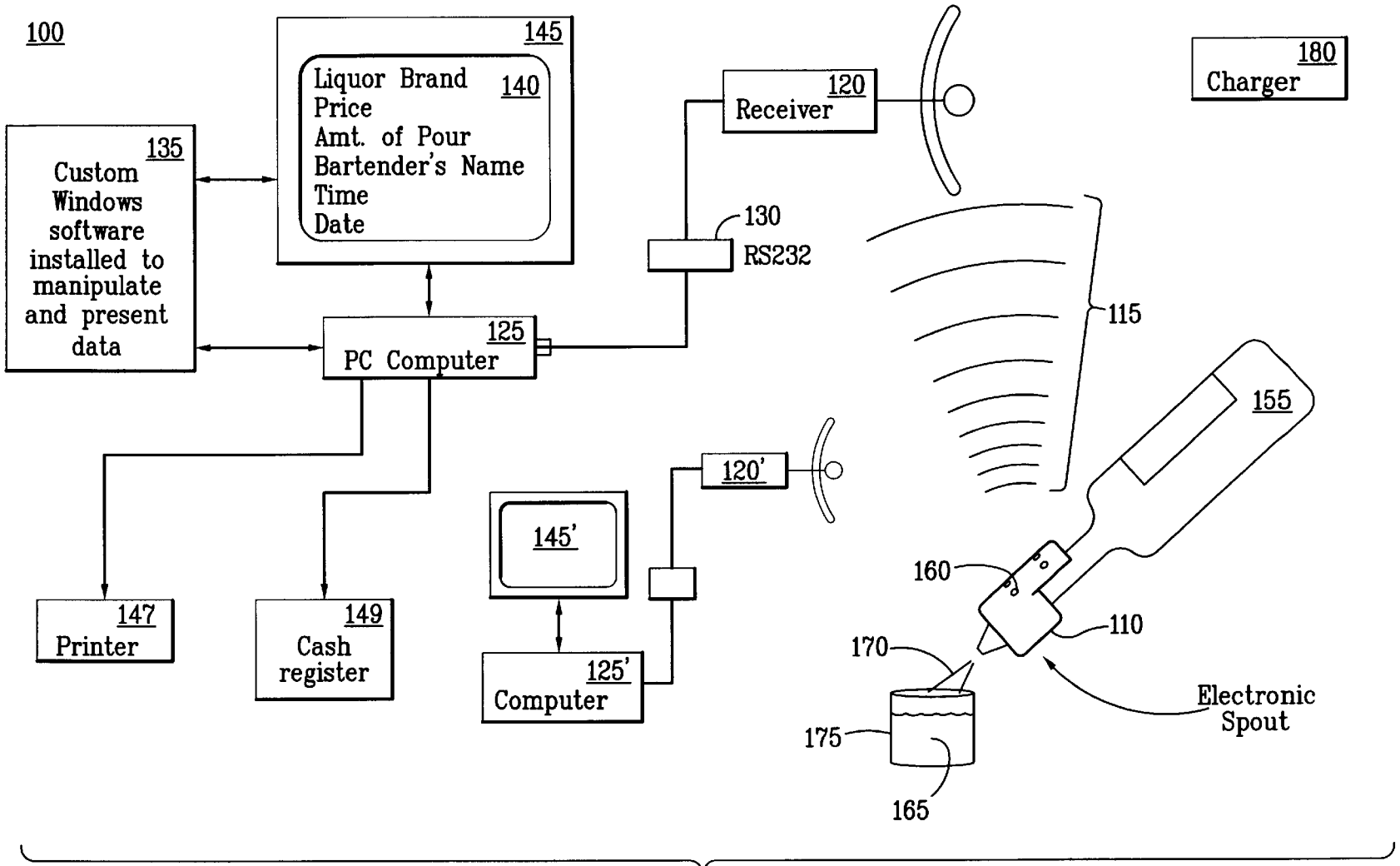
FIG. 1 is a block diagram illustrating the system in accordance with the present invention.

Referring now to FIG. 1, a system 100 includes a head (or spout) 110 which is capable of transmitting a signal 115 to a remote receiver 120. An exemplary head 110 is commercially available from Barmate Corporation, 33 New Montgomery Street, Suite 210, San Francisco, Calif. 94105. The receiver 120 is coupled via an RS-232 link 130 to a computer 125 such as a standard IBM compatible computer. A software program 135 permits the computer 125 to process the signal 115 and to instantly display point-of-sale information 140 on a screen 145 which can, for example, be a touchscreen monitor. The software program 135 can be, for example, a Windows™ based program which manipulates data to provide almost any type of business-related report desired. In addition, the computer 125 can instantly output point-of-sale information 140 to a printer 147 or to a cash register 149.

One or more additional receivers 120' coupled to additional computers 125' and screens 145' may be added as optional features of the system 100 of FIG. 1.

By engaging the head 110 to a bottle 155, the head 110 becomes operational and is turned on. The head 110 continuously monitors a keypad 160 preferably connected to the head 110 for easy access, and continuously monitors the position of the bottle 155. A server or bartender (not shown) uses the keypad 160 to select the desired volume or amount 165 of liquid 170 to pour into a glass or container 175. The keypad 160 preferably comprises of a plurality of labeled "shot size" buttons (see buttons 615, 620, 625, and 630 in FIG. 6). When the server selects a button of the keypad 160, the head 110 records the request and configures itself to pour only the desired volume 165. Thus, when the bottle 155 is inverted, as shown in FIG. 1, the head 110 permits liquid 170 to pour from the bottle 155 for a predetermined period of time, thereby resulting in the desired volume 165 being dispensed. Consequently, the head 110 eliminates "over-pouring." Although the system 100 being described uses a timer to compute the desired volume 165, other volume measuring techniques such as use of in-line flow meters, inductive sensors or weight/volume measurement techniques can alternatively be used.

After the desired volume 165 of the liquid 170 has been poured, the head 110 transmits the signal 115 into the receiver 120. The signal 115 includes between a 8 to 32 bit data packet which is preferably transmitted at an FCC approved frequency. The signals 115 are preferably transmitted multiple times at random intervals when an event (e.g., pouring) occurs, in order to ensure reliable reception. The signal 115 preferably contains essential point-of-sale information 140 such as, for example: (1) the identity of a head 110 which is assigned (via software 135) to a particular liquor brand; (2) the quantity of liquor dispensed; and/or (3) the engagement or disengagement of the head 110 from the bottle 155. Additionally, since the head 110 is able to transmit the point-of-sale information 140 to the remote receiver 120, the present invention permits the server to freely move about the bar without being tied down to a "wired terminal."

In order for the head 110 to be operational, the head 110 must first be engaged onto the bottle 155. In order for the signal 115 to be transmitted, the head 110 must first be engaged to the bottle 155. The signal 115 is also transmitted if a bottle is inverted during engagement to the head 110 or when the head 110 is disengaged from the bottle 155. Other methods of transmission such as infrared beams can also be implemented.

The receiver 120 passes the signal 115 via the RS-232 link 130 to the computer 125 and then to the software 135, which in turn processes the signal 115 to generate and display on the screen 145 the point-of-sale information 140. The software 135 is programmed for tracking the date and time of a transaction, and for matching a liquor brand name and price to a head 110. Typically, the bartender signs onto the computer 125, and the software 135 records all the transactions of the bartender, i.e., the signals transmitted to his or her computer. Specific spouts may be assigned to a particular bartender also.

The system 100 can use the point-of-sale information 140 to generate, for example, sales reports, to generate individual transaction receipts, and to determine the "best selling" and "worst selling" liquor brands. The system 100 can also monitor the poured and remaining volumes of liquid 170 for each bottle 155 to record inventory. The system 100 also records the engagement and disengagement of the head 110 from the bottle 155, thereby allowing the system 100 to detect any cheating or unauthorized pouring by the bartender.

Figure 2:
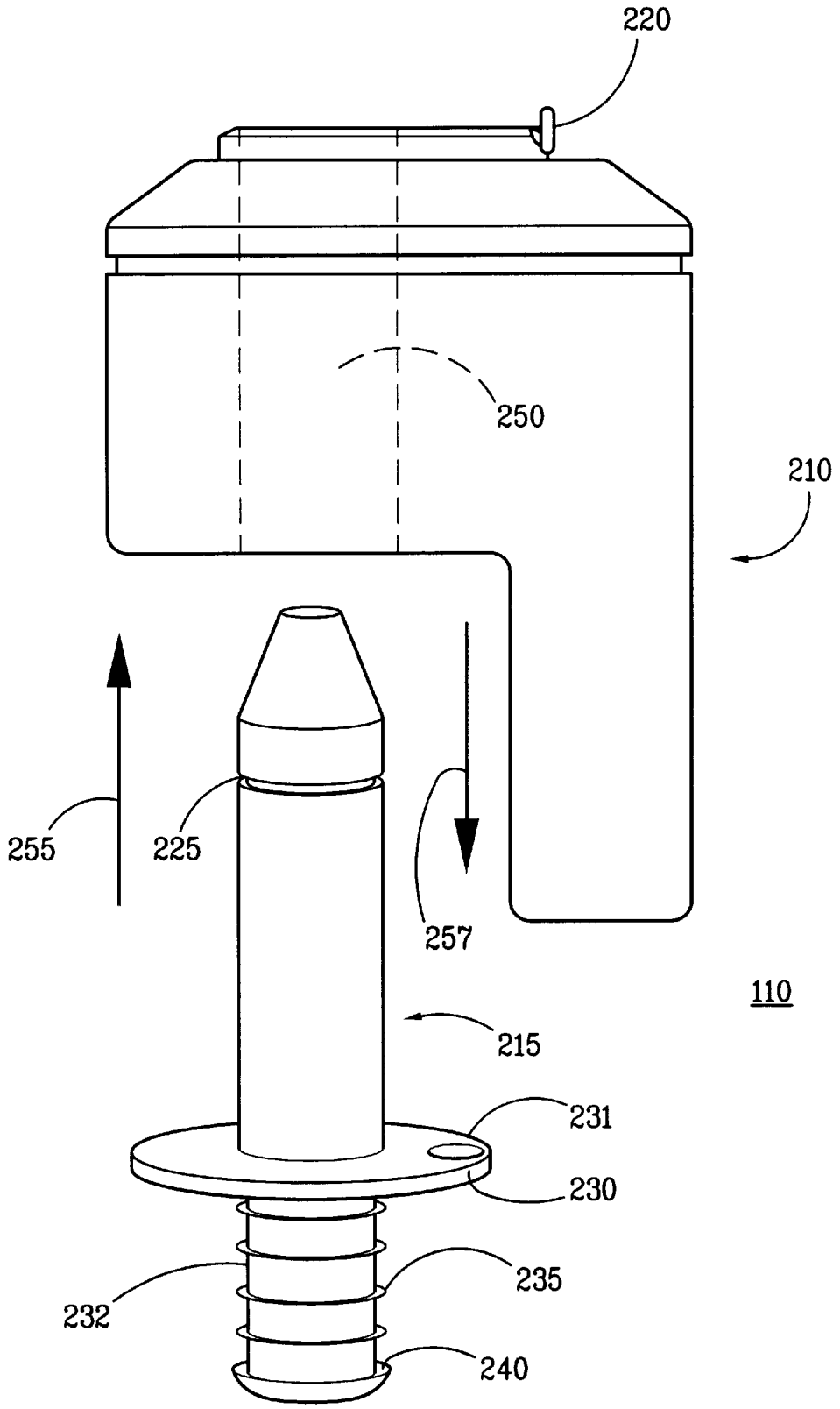
FIG. 2 is a detailed view illustrating the head (spout) of FIG. 1 with the inner valve core and outer electronic shell components.

FIG. 2 is a detailed view of the head 110, which includes an inner core assembly 215, an electronic shell assembly 210 and a latch 220 for connecting the inner core assembly 215 to the electronic shell assembly 210. The latch 220 engages or disengages the groove 225 on the inner core assembly 215. The inner core assembly 215 includes a cylinder flange 230 which, when the inner core assembly 215 is inserted into the bottle, abuttably connects with the bottle 155 opening to create a water-tight seal and prevents the inner core assembly from falling into the bottle 155. The flange 230 also has a recessed area 231 which receives the button 520 (see FIG. 5) and facilitates direct contact between the button 520 and an engaged bottle 155. As discussed below, the button 520 permits the monitoring of engaging and disengaging activities between the head 110 and a bottle 155.

The inner core assembly 215 further includes cork-stopper 232, preferably made of plastic, for insertion into the bottle 155 opening. Although the inner core assembly 215 and the cylinder flange 230 are described as cylindrical, other shaped components can alternatively be used. The inner core assembly 215 includes a taper 240 at its end to prevent the cork-stopper 232 from being stuck in the bottle 155 (see FIG. 1) when disengaging the cork-stopper 232 from the mouth of the bottle 155.

To connect the inner core assembly 215 to the electronic shell assembly 210, the inner core assembly 215 is inserted into a housing hole 250 in the direction of arrow 255. To disconnect the inner core assembly 215 from the electronic shell assembly 210, the inner core assembly 215 is removed from the housing hole 250 in the direction of arrow 257 or alternatively if the inner core assembly 215 is on the bottle 155, the outer shell assembly 210 may be removed first in the reversed direction. As stated above, the latch 220 connects and disconnects the inner core assembly 215 to the electronic shell assembly 210 by sliding the latch 220 in and out of the groove 225.

Figure 3:
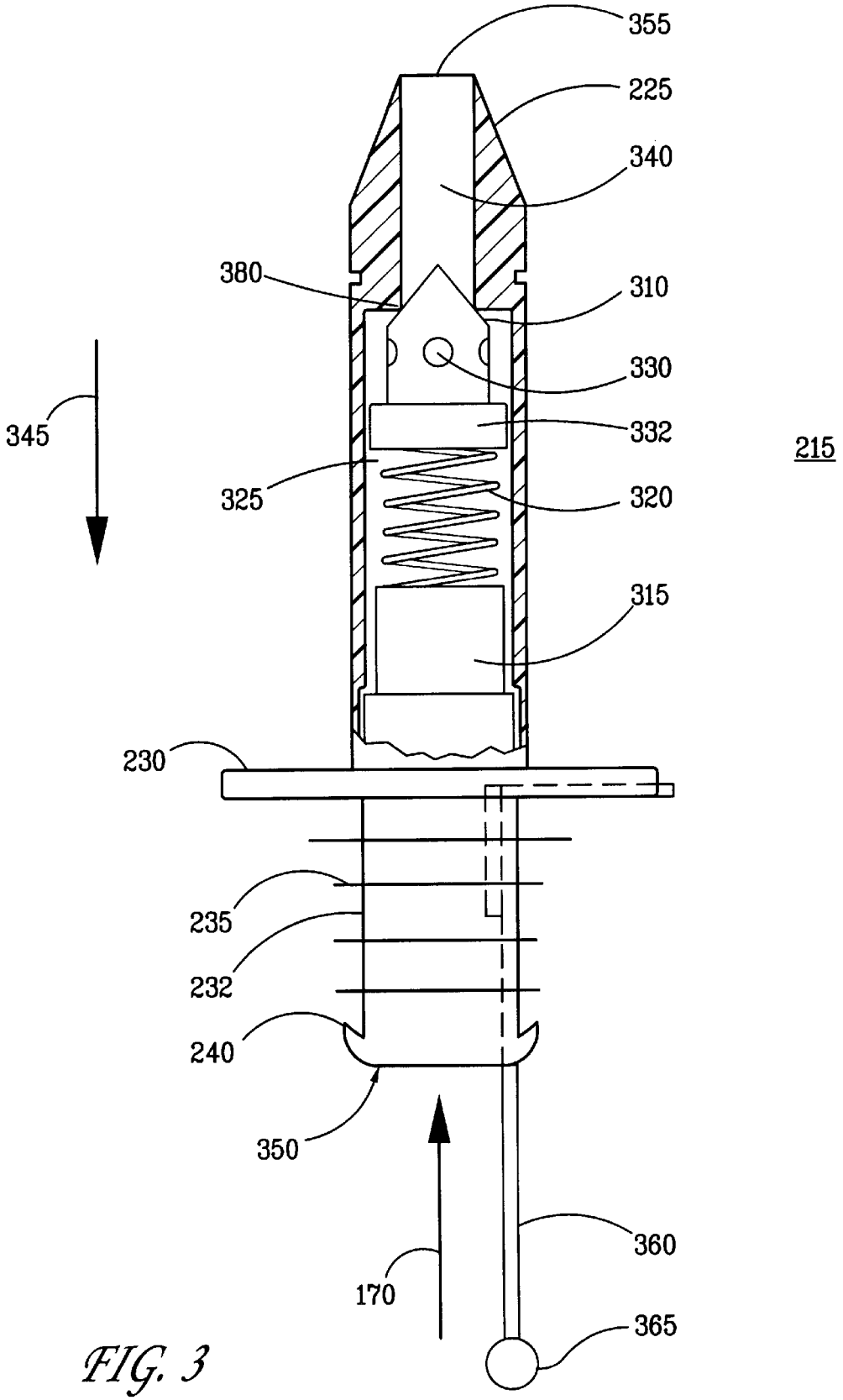
FIG. 3 is a detailed cross sectional view illustrating the inner core assembly of FIG. 2 before and after the pouring of liquid.

FIG. 3 is a detailed cross-sectional view of the inner core assembly 215 which is constructed from plastic or non-conductive material. The inner core assembly 215 includes a plunger 310 which is coupled to a spring 320 which is in turn coupled to a cylindrical adapter 315. The plunger 310, adapter 315 and spring 320 are each disposed within a first cavity 325 within the inner core assembly 215. The plunger 310 and the adapter 315 are preferably constructed from FDA certifiable magnetic stainless steel. The plunger 310 preferably includes a plunger base 332 and a plurality of holes 330 to permit fluid-flow therethrough. To dispense the liquid 170, the plunger 310 is drawn towards the adapter 315 in the direction of arrow 345 for a period of time which enables the pouring of a pre-selected amount of liquid 170 through the base and the plunger and through the outlet of the inner core assembly 215. In addition, the conical shape of the plunger 310 provides an efficient laminar flow of liquid.

In operation, the liquid 170 enters through an opening 350 of the inner core assembly 215 and passes into the first cavity 325 preferably until the first cavity 325 is entirely filled. The plunger 310 is then drawn "downward" (in the arrow 345 direction) so that the liquid 170 can pass into and can exit from the opening 355. To improve pouring, air is allowed to enter the bottle 155 (see FIG. 1) through a standard airvent tube 360 that includes a check-valve mechanism 365. The check-valve mechanism 365 permits air to enter the bottle 155 (see FIG. 1), but prevents the liquid 170 from exiting the airvent tube 360.

FIG. 3 shows the position of plunger 310 before and after the pouring of the liquid 170. Initially, the spring 320 biases the plunger 310 against the chamber seat 380 and thereby seals the opening 355 by pressing the plunger against the chamber seat 380. The liquid 170 therefore cannot exit from the opening 355.

Figure 4:
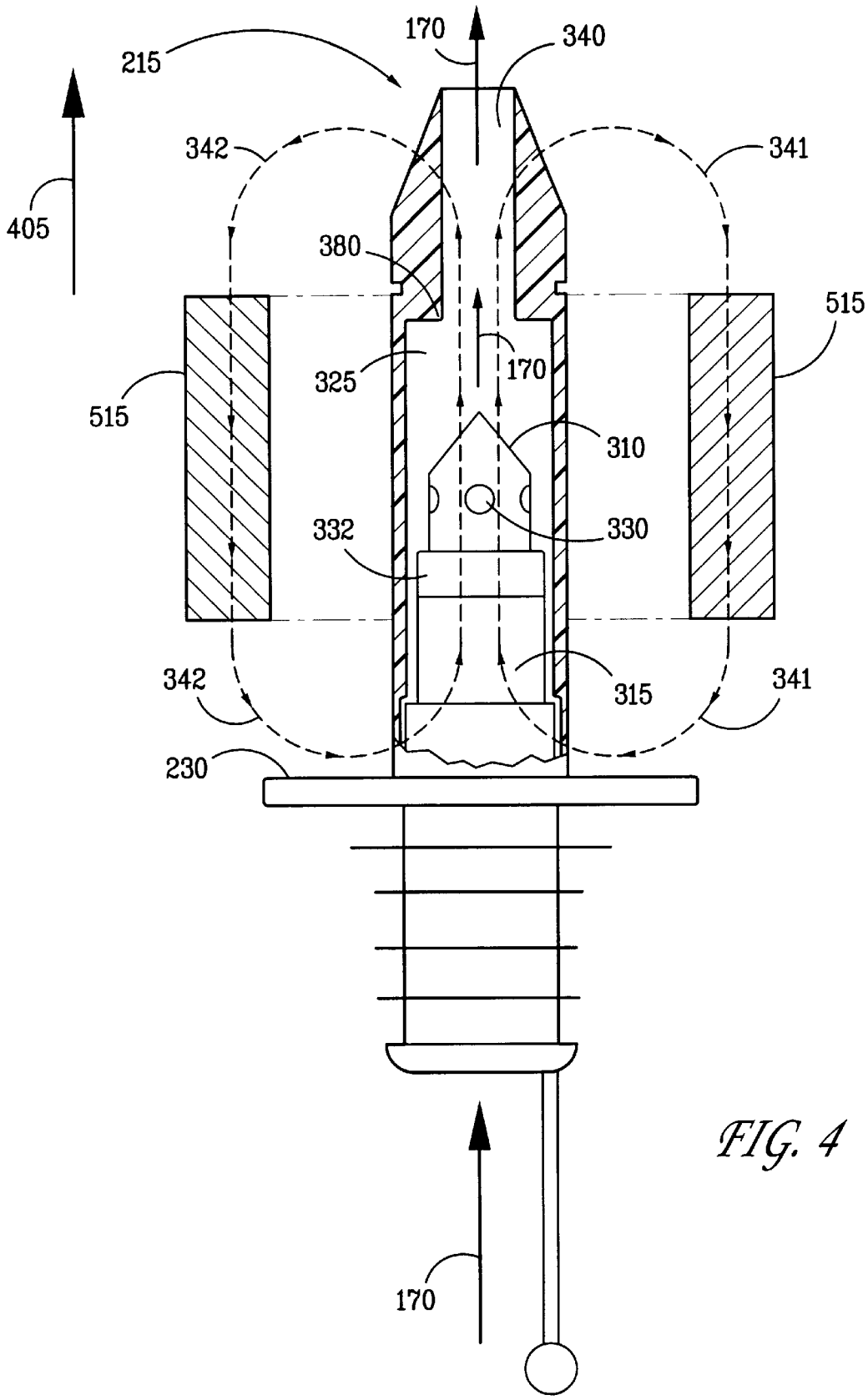
FIG. 4 is a detailed cross sectional view of the inner core assembly of FIG. 2 during the pouring of liquid.

FIG. 4 is a detailed cross-sectional view of the inner core assembly 215 during the pouring of liquid. During the pouring of the liquid 170, a magnetic or equivalent attractive force is applied to the plunger 310 to counteract the spring 320 force. The magnetic flux provided by the solenoid coil 515 is best represented by the oval shape dashed arrows 341 and 342. Accordingly, the plunger 310 is drawn "downward" against the adapter 315. When the magnetic force holding the plunger 310 to the adapter 315 is removed, the spring 320 forces the plunger 310 (in the direction of arrow 405) to its original biased position against the chamber seat 380.

Figure 5:
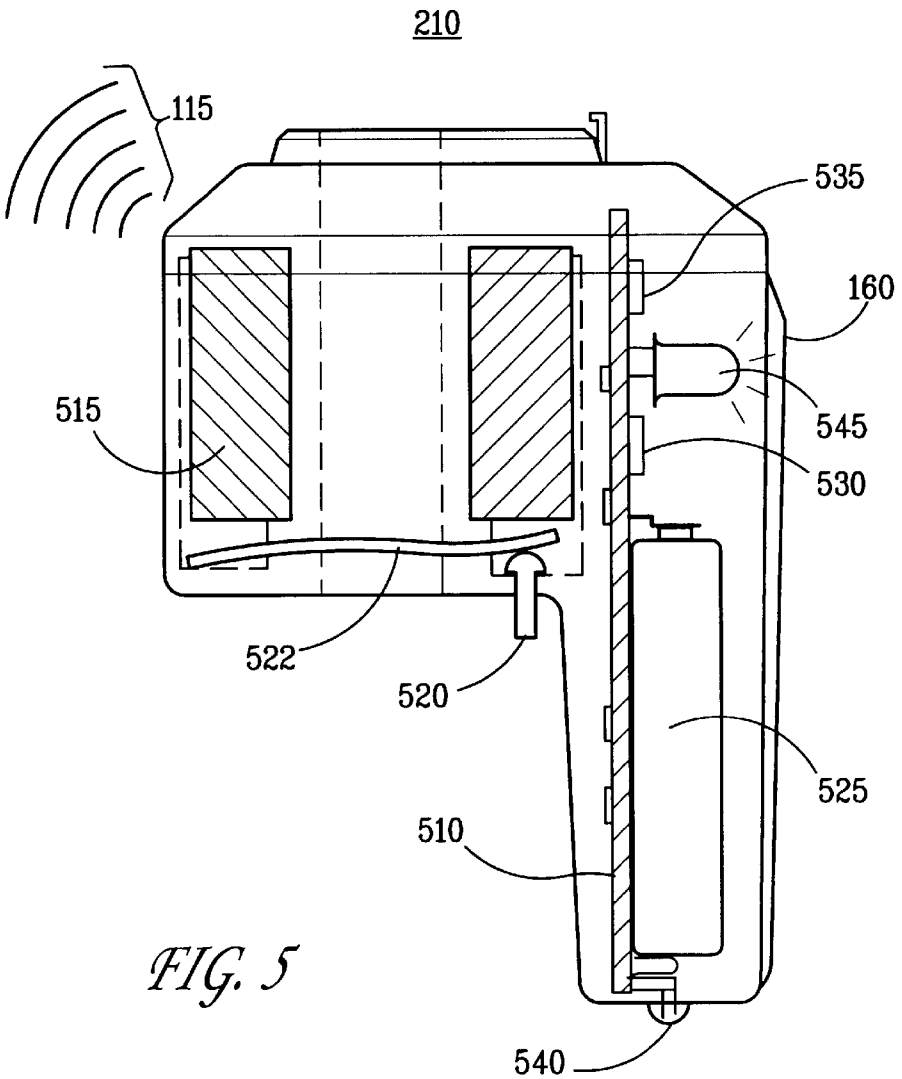
FIG. 5 is a detailed cross sectional view illustrating the electronic shell assembly of FIG. 2.

FIG. 5 is a detailed cross-sectional view of the electronic shell assembly 210, which includes a main circuit board 510, a solenoid coil 515, button 520, contact ring 522 sitting on the circuit board and preferably the keypad 160. The electronic shell assembly 210 and button 520 are preferably made of plastic, and the contact ring 522 is preferably made of beryllium copper. The main circuit board 510 includes one or more rechargeable batteries 525 for supplying a source of power to the head 110, microcontrollers 530 for controlling the flow of liquid 170 (and for supervising the head 110 and storing and controlling the transmission of relevant activities), a transmitter 535 for transmitting the signal 115 to the receiver 120, a battery-charging contact 540 for connecting the electronic shell assembly 210 with a battery charger 900 as described in FIG. 9, and a light-emitting diode 545 indicator.

Figure 6:
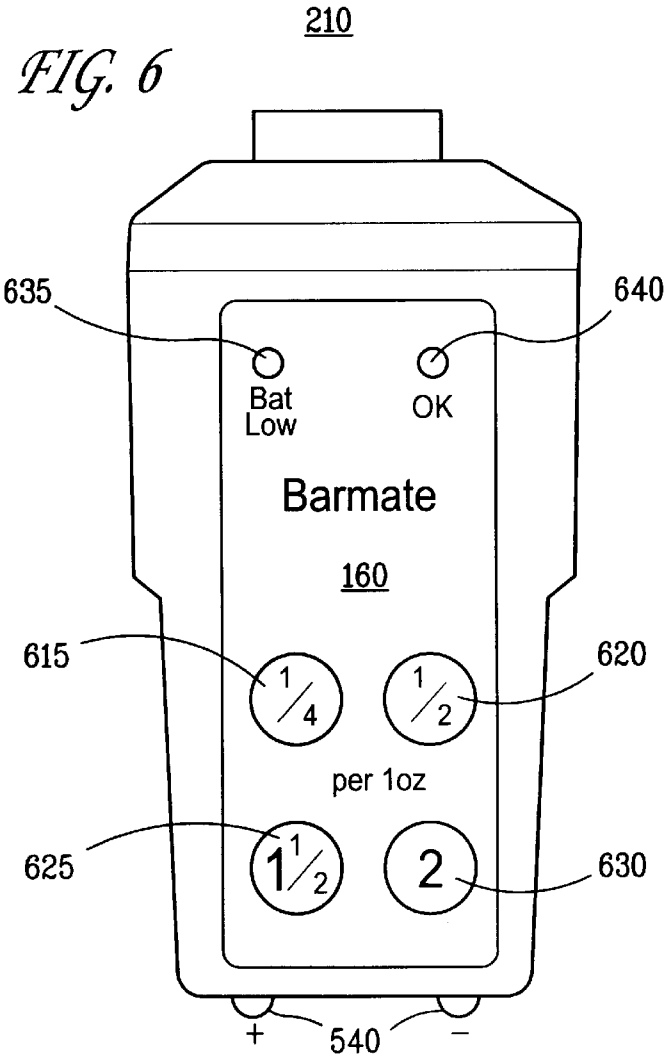
FIG. 6 is a detailed view illustrating the keypad of FIG. 1.

FIG. 6 is a detailed view of the keypad 160 on the electronic shell assembly 210. The keypad 160 preferably includes a "shot-size" button 615 labeled "¼", a button 620 labeled "½", a button 625 labeled "1½" and a button 630 labeled "2". The bartender selects one of the buttons 615, 620, 625 or 630 to pour ¼ oz., ½ oz., 1½ oz., or 2 oz. of liquid 170, respectively. Prior to inverting the bottle 155, the bartender presses one of the buttons 615, 620, 625, or 630, to select a desired liquid amount to be poured. The buttons may, as an example, be ergonomically positioned on the head 110 for permitting easy access to the buttons for the bartender. Microcontrollers 530 (see FIG. 5) control the amount of time that the plunger 310 contacts the adapter 315 (see FIG. 3). If the bartender does not select one of the buttons 615, 620, 625, or 630 before inverting the bottle 155, then a default amount such as one ounce will be dispensed from the bottle 155. This default feature permits the bartender for quick turn-around since the pressing of buttons is minimized. Thus, unlike conventional liquor control systems, the present invention provides an automatic select feature for volume control, thereby permitting the server to pour two or more bottles simultaneously. In addition, the automated feature of the invention improves server efficiency and eliminates fraud and "overpouring," while providing a reliable and more detailed method for inventory tracking. The present invention also provides a wireless system which is extremely efficient for high volume cycles, without requiring the bulky, noticeable, and constraining liquor control devices of conventional systems.

The keypad 160 also includes an indicator 635, which informs the bartender when the rechargeable batteries 525 (see FIG. 5) require recharging. Keypad 160 also includes an "OK" indicator 640 which informs the bartender of events such as the pouring of liquor or the engagement or disengagement of the head 110 (see FIG. 1) from the bottle.

Figure 7:
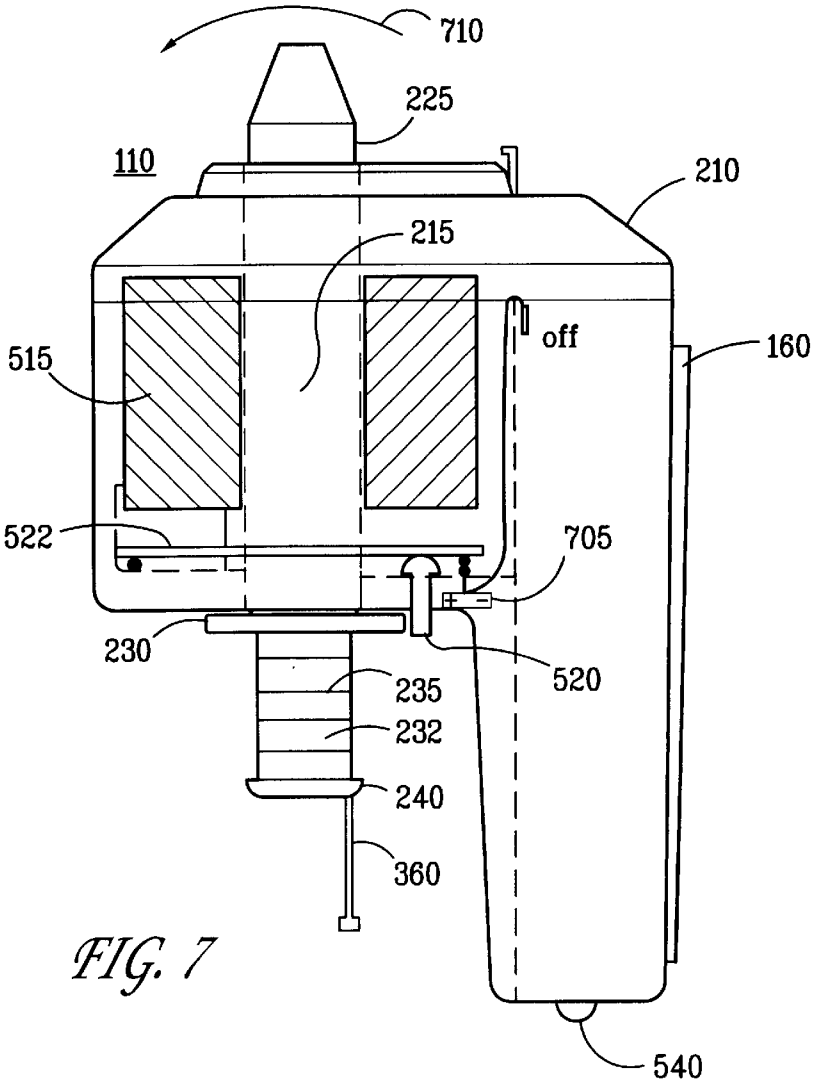
FIG. 7 is a detailed cross-sectional view of the head of FIG. 1 when disengaged from a bottle.

FIG. 7 is a detailed cross-sectional view of the head 110 when disengaged from a bottle 155. When disengaged, the contact ring 522 is in contact with the contact leads 705, resulting in a closed circuit which turns off the head 110. Thus, when the head 110 is inverted in the direction of arrow 710, the transmitter 535 (see FIG. 5) does not send the signal 115 (see FIG. 1) to receiver 120 (see FIG. 1), thereby preventing false signals 115. This feature of the invention eliminates unnecessary transmission of the signal 115 if the head 110 is off a bottle 155 and is being inverted unknowingly or intentionally.

Figure 8:
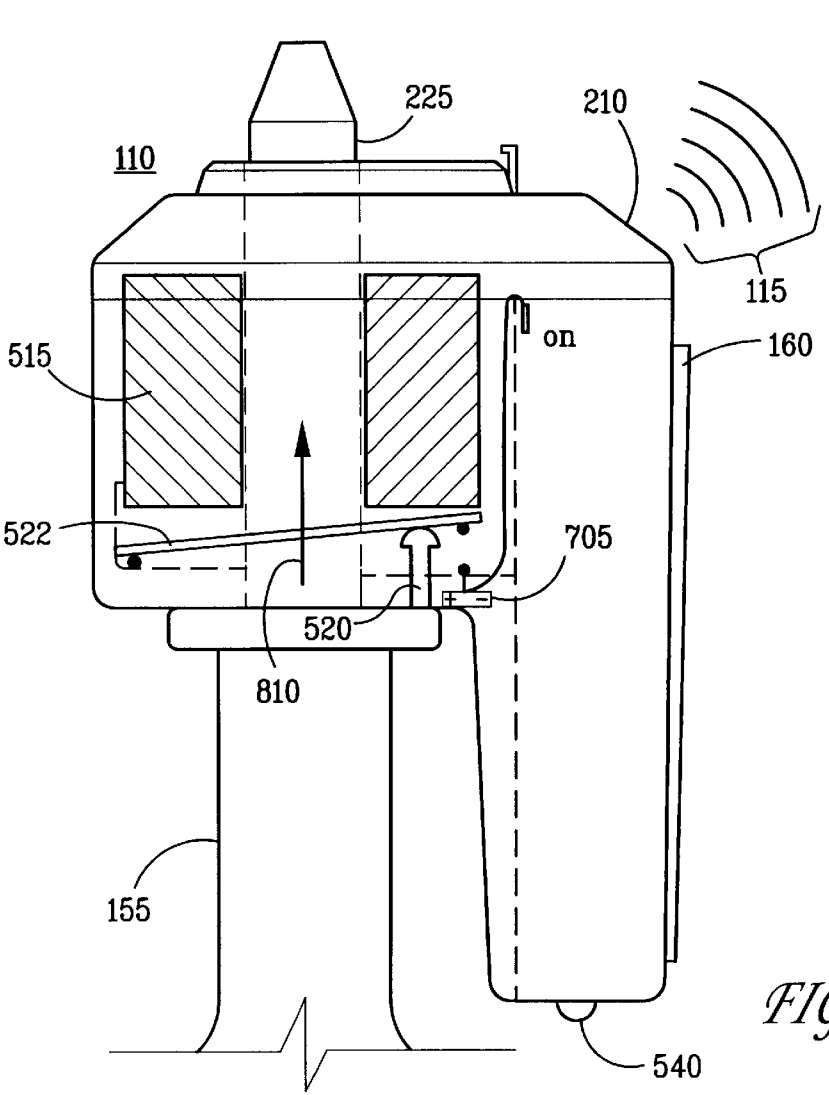
FIG. 8 is a detailed cross-sectional view of the head of FIG. 1 when engaged to a bottle.
Figures 14A, 14B:
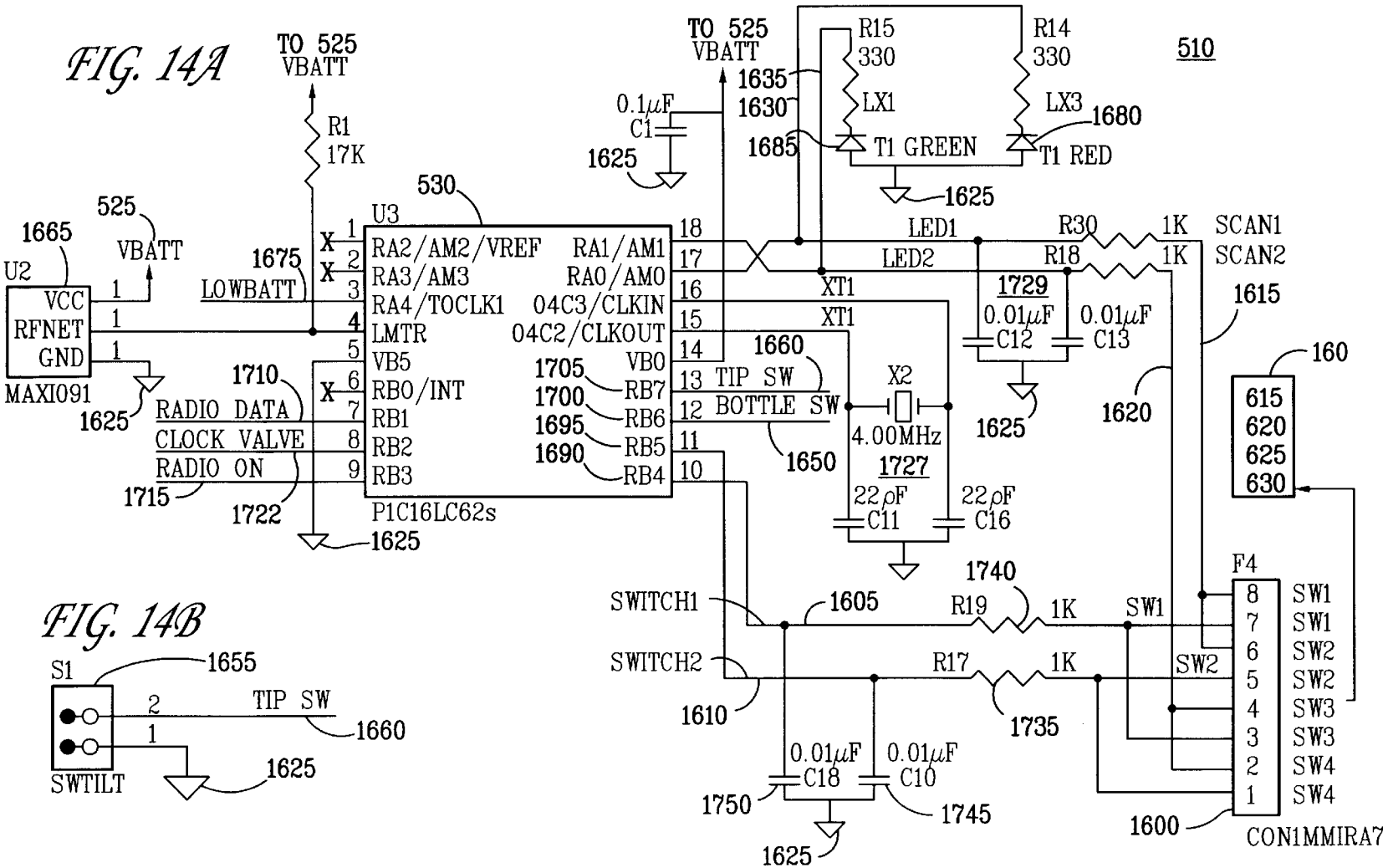
FIGS. 14A, 14B, 14C, 14D, 14E, 14F are schematic diagrams showing a preferred embodiment of the circuit board of FIG. 5 and showing some components of the electronic shell assembly.
Figure 14D:
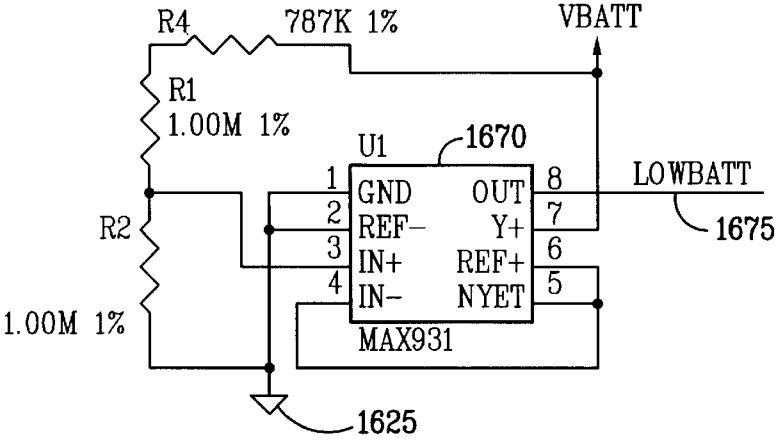
Figure 14E:
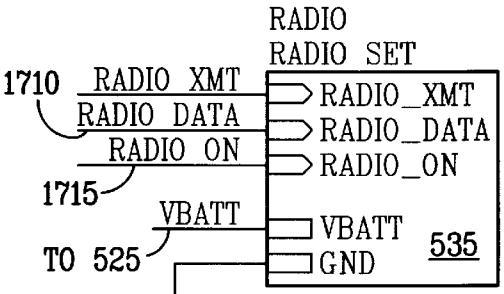
Figure 14C:
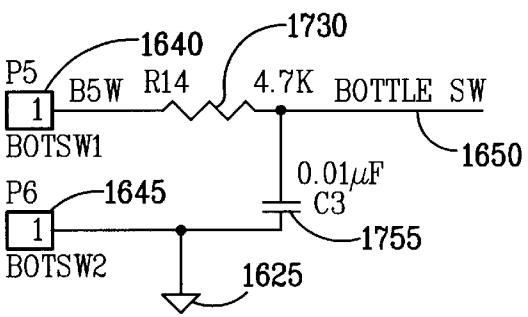
Figure 14F:
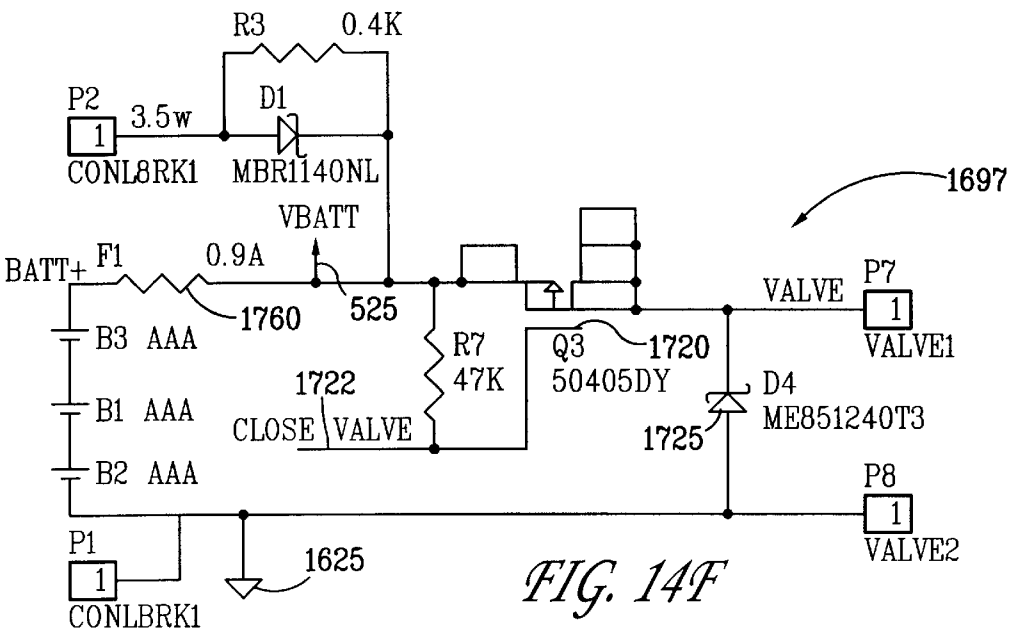

FIG. 8 is a detailed cross-sectional view of the head 110 when engaged to a bottle 155. When engaged, the button 520 pushes against the bottle 155 lip and drives the contact ring 522 in the direction of arrow 810 to push the contact ring 522 away from the contact leads 705 in an open circuit position which turns on the head 110. Accordingly, the head 110 is empowered to detect inputs from the keypad 160, to detect changes to the position of the bottle 155, and to monitor the switch 520 (FIGS. 7 and 8) which detects the presence of the bottle. The position-detection mechanism may include a mercury switch 1655 (see bottle tip switch 1655 in FIG. 14C) or any other equivalent switch mechanism.

When the user presses any one of the buttons 615, 620, 625 or 630, the user is actually setting and selecting the timer for the appropriate pour amount. After the bottle 155 has been inverted for pouring the liquid 170, the timer is actuated by the mercury switch 1655 (see FIG. 14C), and a small amount of current (for example, approximately less than 1.0 ampere) is supplied to the solenoid coil 515. As best shown in FIG. 4, the magnetic force provided by the solenoid coil 515 then draws the plunger 310 towards the adapter 315 in the direction of arrow 345 which enables the pouring of a pre-selected amount of liquid 170. The quantity of liquid poured is based on the time (set by the timer) for which electrical current is supplied to the solenoid coil 515. After the pour has been completed, the transmitter 535 (FIG. 14E) transmits, for example, between a 8 to 32 bit data packet signal 115 (FIG. 1) to the receiver 120 (FIG. 1) so that the computer 125 (FIG. 1) can record the head 110 serial number and other information provided by the signal 115.

Figure 9:
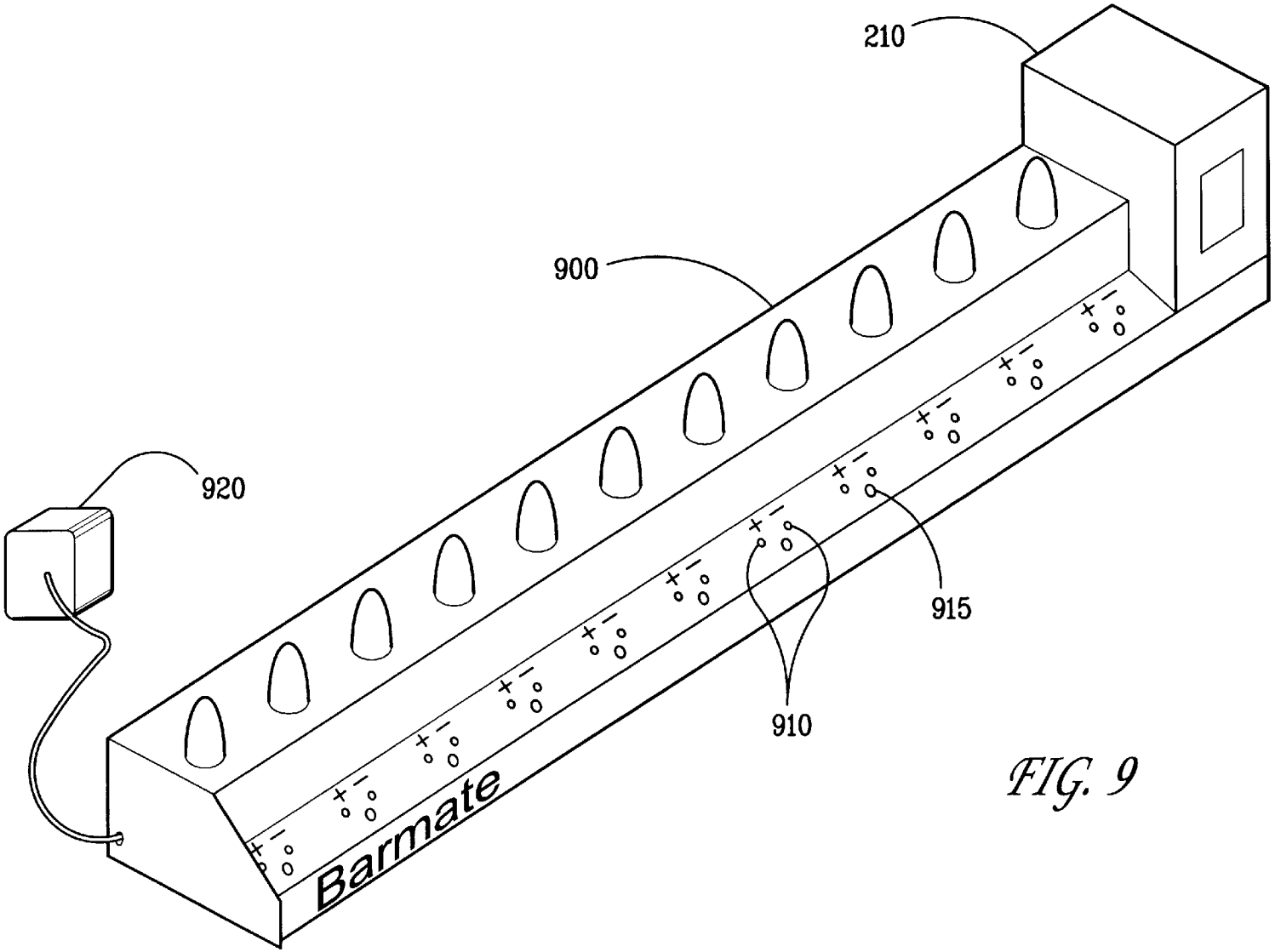
FIG. 9 shows a battery charger for recharging the rechargeable batteries of the multiple heads of FIG. 1.

FIG. 9 shows a battery charger 900 for recharging the rechargeable batteries 525 of multiple heads 110. The battery charger 900 includes a plurality of positive and negative input terminals 910 for receiving the battery-charging contacts 540 (see FIG. 7) of electronic shell assembly 210. A plurality of LEDs 915 may indicate to the user when the batteries 525 are fully charged. The battery charger 900 is powered by a standard power supply 920. The electronic shell assembly 210 is usually mounted to the battery charger 900 without the inner core assembly 215 (FIG. 7), since the inner core assembly 215 may be washed while the electronic shell assembly 210 is being charged.

Figure 10:
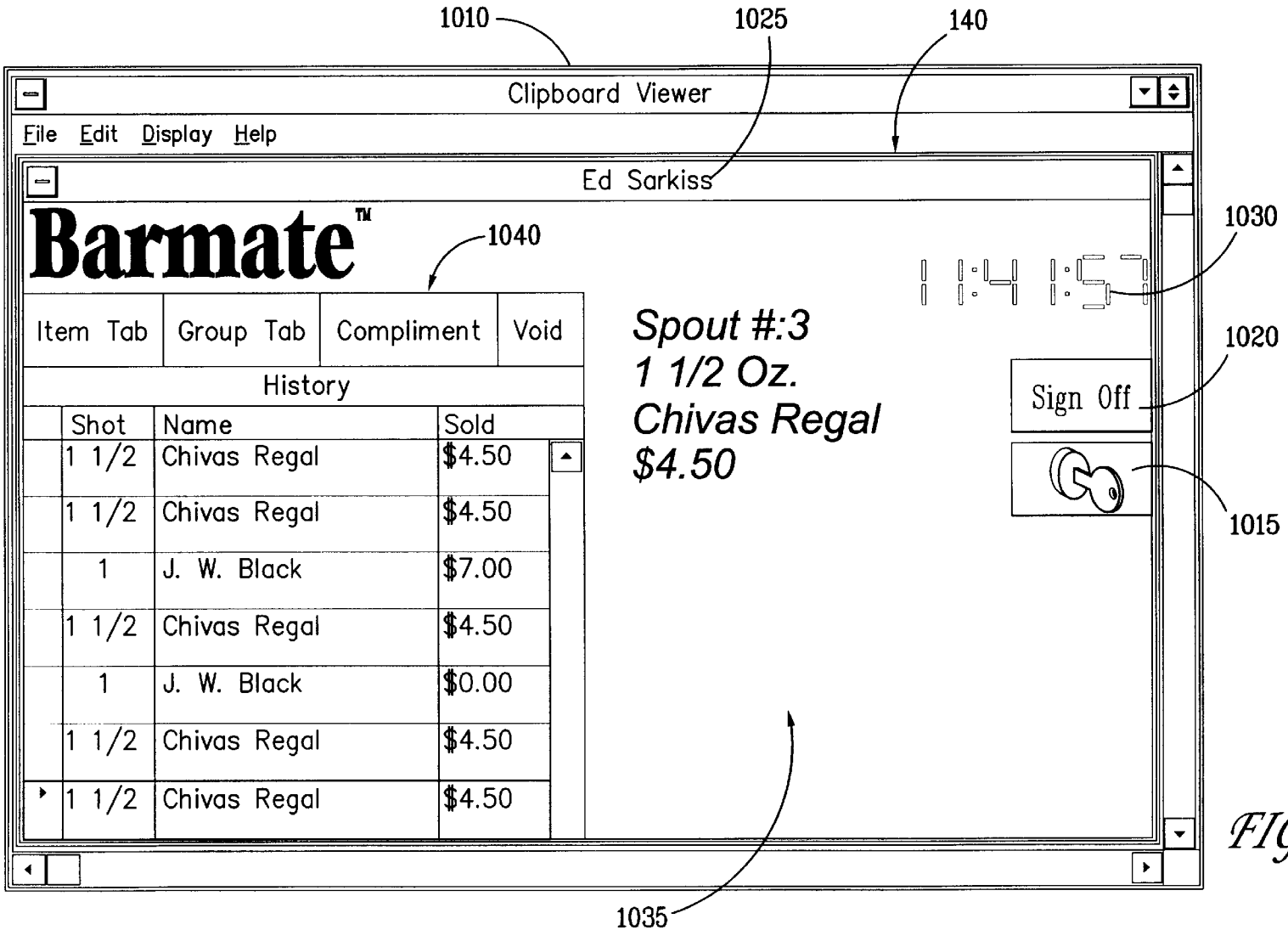
FIG. 10 shows the Main Screen view provided by the software program of FIG. 1.

FIGS. 10–13 illustrate various screen views seen from the screen 145 (see FIG. 1) and provided by the software program 135 (see FIG. 1). Referring first to FIG. 10, a Main Screen view 1010 is shown. "Access to Management Module" 1015 and "Sign Off" 1020 control buttons are seen on the right side of the Main Screen view 1010. The Main Screen view 1010 also displays point-of-sale information 140, such as the bartender's name 1025, time of transaction 1030, current transaction data 1035 such as current transaction spout (head) number, shot size, liquor brand and price, and record portion 1040 which shows historical data concerning the shot size, liquor brand and price. The record portion 1040 is used for automatically ringing up customers.

Figure 11:
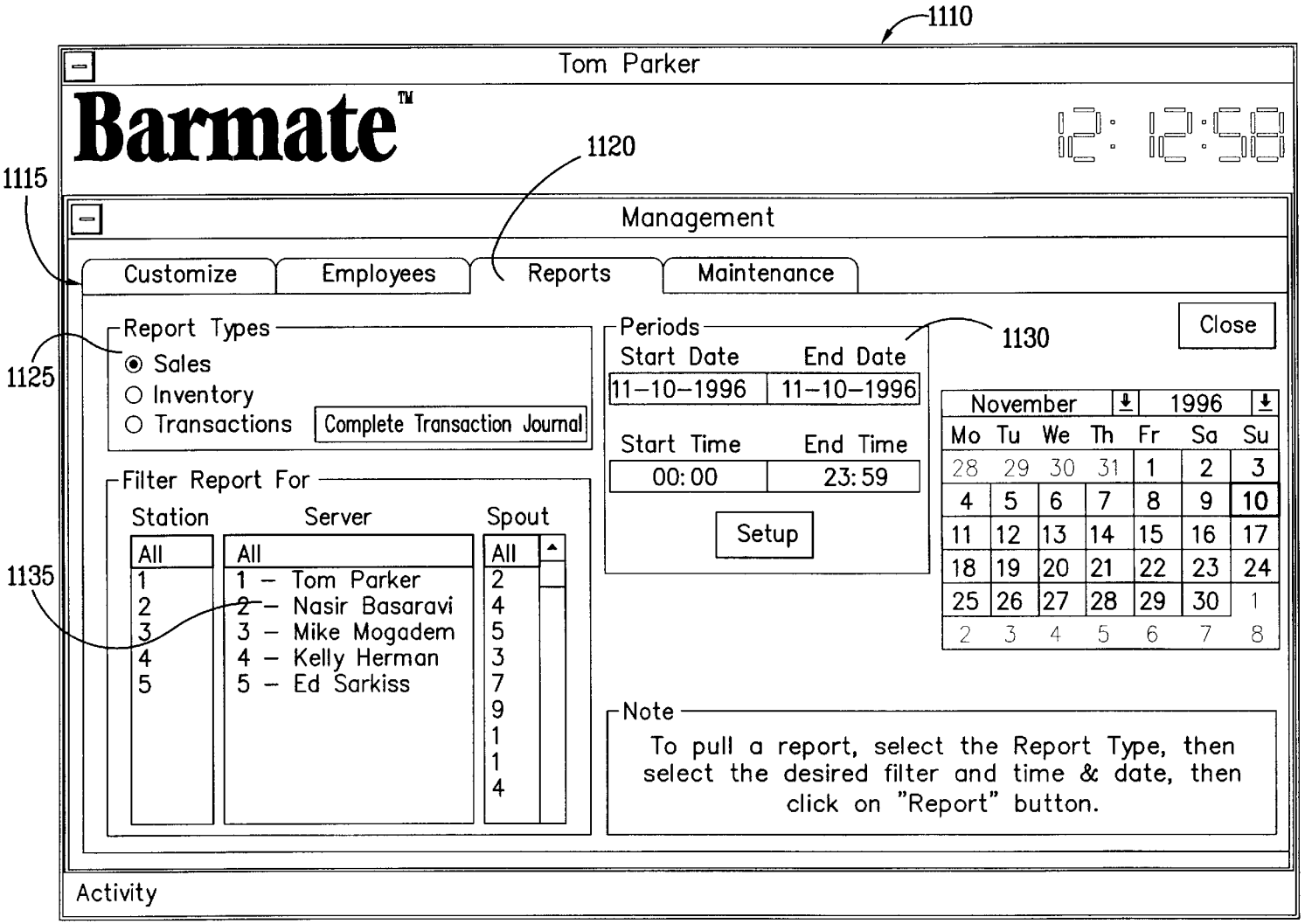
FIG. 11 shows the Management Module view provided by the software program of FIG. 1.

FIG. 11 is a Management Module view 1110 that permits managerial employees to customize and review reports of all transactions. From the Management Module view 1110, the manager can pick among selections 1115, which include "customize" for designating heads 110 serial numbers to liquor brands, and for price and bottle size designations. Selections 1115 also includes: "employees" for updating the employee information; "reports" 1120 for generating customized and filtered reports to monitor employee performance, up-to-date sales, and inventory; and "maintenance" for updating data and maintaining the database.

By selecting reports 1120, the managerial employee can pick report types 1125 (sales, inventory or transaction reports), time and date periods 1130 which are desired for the reports, and the server names 1135. Reports 1120 enables the managerial employee to filter the information recorded by the system 100 to accommodate real-time needs.

Figure 12:
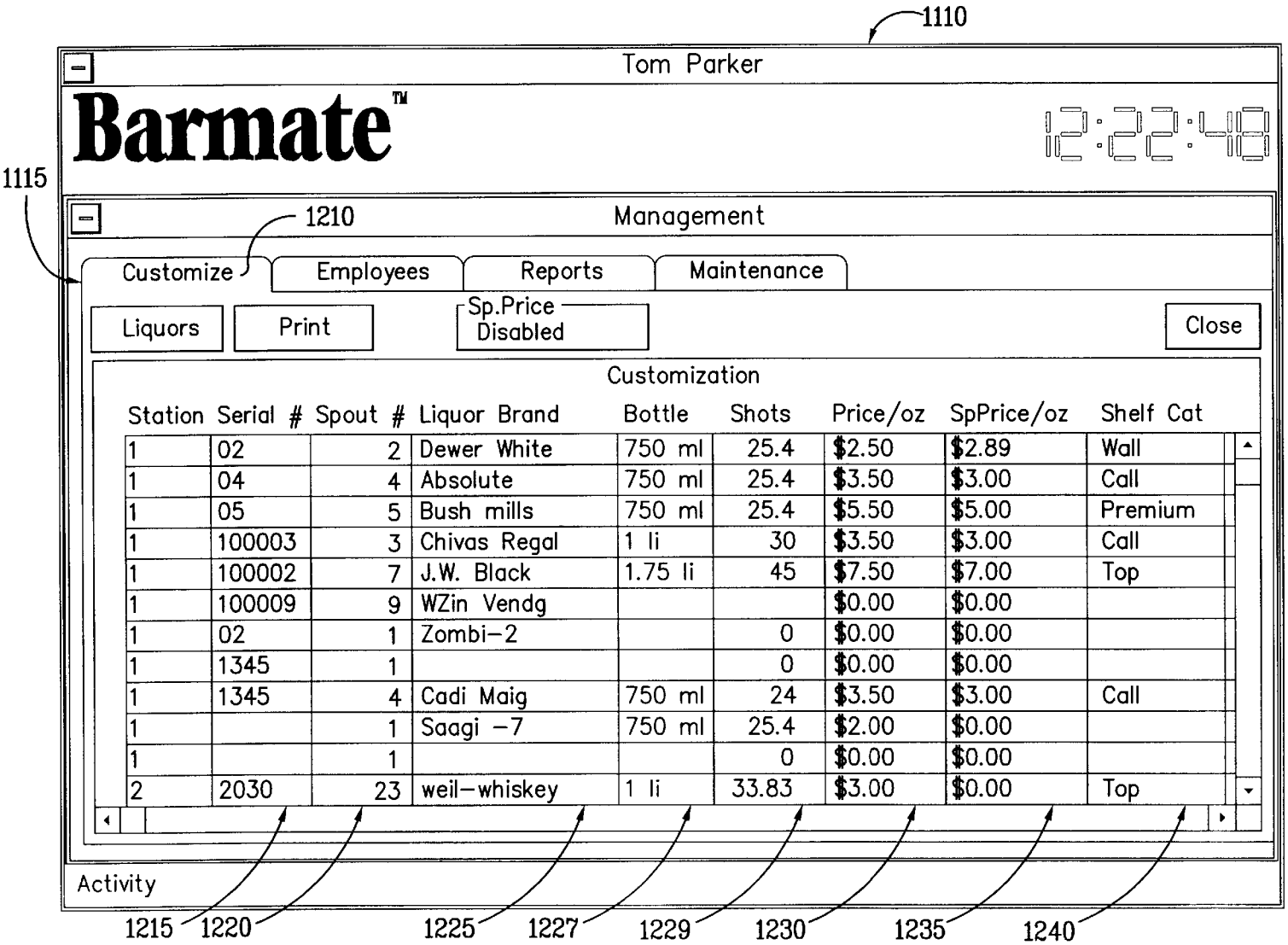
FIG. 12 shows the Management Module view provided by the software program of FIG. 1, when the "customize" selection is selected.

FIG. 12 shows Management Module view 1110 when the "customize" selection 1210 is selected from the selections 1115. The customize function enables the managerial employee to assign a particular head 110 serial number to a particular liquor brand or price. For example, the managerial employee may assign the head 110, which has serial number 1215, to the local head numbers 1220, the corresponding liquor brands 1225, the bottle size 1227, the number of shots 1229, the price per ounce 1230, a special price per ounce 1235 and the shelf category 1240 such as well, call, premium, top, etc. Thus, by the practice of the present invention, an advantage is achieved whereby various choices of liquor brands, pricing levels, bottle sizes can be set for various spouts 110. This flexibility is not provided by analog systems which limit choices to a few pricing categories and do not provide brand identification. The present invention has a further advantage in not requiring all information to be programmed in hardware, since the Windows™ based software 135 permits information (e.g., pricing levels) to be set after production.

Figure 13:
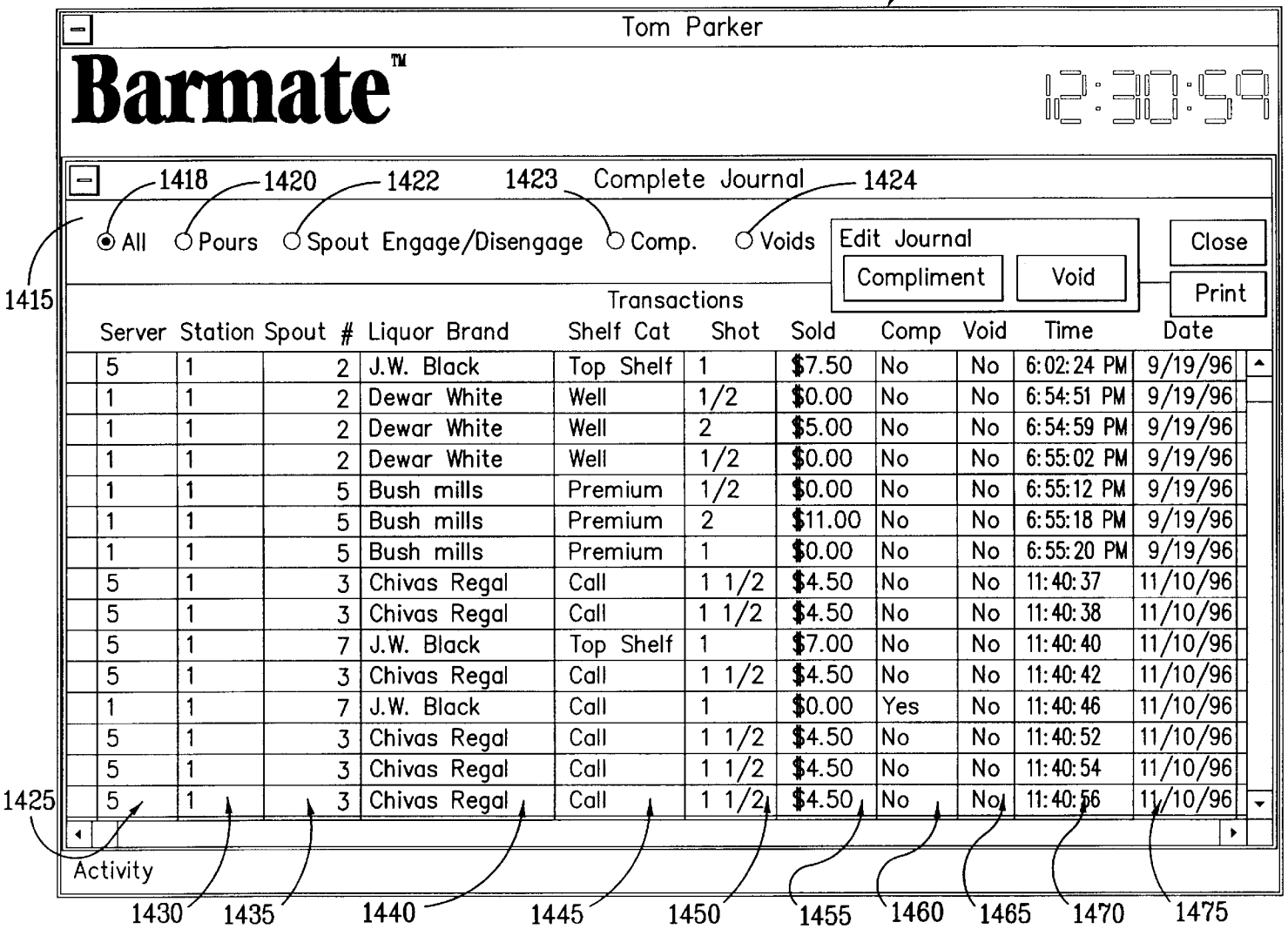
FIG. 13 shows a complete activity journal screen view provided by the software program of FIG. 1.

FIG. 13 shows a complete journal screen view 1410 of selected activities 1415, which include "all" 1418, "pours" 1420, spout engagement or disengagement 1422, complimentary servings 1423 and voided transactions 1424. When. "all" 1418 is selected, the following information is available: server identification 1425, station location 1430, spout (head) identifications 1435, liquor brands 1440, shelf categories 1445, shot sizes 1450, transaction prices 1455, complementary servings 1460, voided transactions 1465, transaction times 1470, and transaction dates 1475. The complete journal screen view 1410 provides a complete historical journal of every activity recorded by the system 100, and serves as the main database for generating the sales and inventory reports. Although not illustrated, the sales or inventory reports can also be made for individual servers. Thus, the invention can generate sales and inventory reports, and generate automatic "ring-ups" on a touchscreen monitor.

FIGS. 14A, 14B, 14C, 14D, 14E, 14F are schematic diagrams showing a preferred embodiment of the circuit board 510 and showing some components of the electronic shell assembly 210 of FIG. 5. Buttons 615, 620, 625 and 630 on the keypad 160 are coupled to a multiplexer 1600 (P4). The signals from the keypad 160 are multiplexed by the multiplexer 1600 into a 2-by-2 array to the microcontroller 530 (U3) . The microcontroller 530 is preferably a low-power RISC-type microprocessor unit with integrated peripherals and with high-current capability input/output lines. The microprocessor 530 also runs at about 4.0 MHz, resulting in one instruction per microsecond of execution time. The microprocessor 530 is coupled to the multiplexer 1600 by lines 1605 (SWITCH1), 1610 (SWITCH2), 1615 (SCAN1), and 1620 (SCAN2). The microprocessor 530 is also coupled to the battery supply 525 (VBATT), and is grounded at 1625.

The lines 1615 (SCAN1) and 1620 (SCAN2) are also coupled with the LED drive signal lines 1630 (LED2) and 1635 (LED1), respectively.

The bottle sense switches 1640 (P5) and 1645 (P6) have an output line 1650 ("BOTTLE SW"). The output line 1650 is coupled to the microprocessor 530. The bottle tip switch 1655 (S1) has an output line 1660 ("TIP SW"). The output line 1660 is coupled to the microprocessor 530.

The circuit board 510 also includes a reset element 1665 (U2) which is coupled to the microprocessor 530, the battery supply 525, and ground 1625. The reset element 1665 insures that the circuit board 510 enters a safe reset condition when the voltage of battery supply 525 falls below 2.9 V.

A comparator 1670 (U1) is coupled to the microprocessor 530 by the line 1675 ("LOWBATT"). The comparator 1670 also monitors the voltage of battery supply 525 to indicate when the battery voltage has fallen below 3.3 V. The microprocessor 530 reads the signal from the line 1675 of the comparator 1670, and the microprocessor 530 subsequently illuminates the light emitting diode 1680 (LED "D3"). When the microprocessor 530 is inactive, the microprocessor 530 enters a low power state whereby the battery life is maximized. Transitions on ports 1690 ("RB4"), 1695 ("RB5"), 1700 ("RB6"), and 1705 ("RB7") will wake the microprocessor 530 out of this inactive state.

The radio transmitter 535 is coupled to the microprocessor 530 by line 1710 to port RB1, by line 1715 to port RB3, and to the battery supply 525.

The circuit board 510 further includes valve connections 1697. Actuation of the solenoid coil 515 is controlled by a switch 1720 which is, for example, a low resistance P-channel MOSFET. By actuating the solenoid coil 515, its magnetic force draws the plunger 310 (FIG. 3) towards the adapter 315 (FIG. 3), in the direction of arrow 345. The solenoid coil 515 is initially engaged with constant voltage until it is fully actuated. After about 100 milliseconds, the power to the solenoid coil 522 is then modulated to less than 100% (e.g., about 30%) to minimize drain on the battery supply 525 until the completion of the cycle. This modulation is controlled, for example, by software within the microcontroller 530. Line 1722 couples valve connections 1697 to the microprocessor 530 at port RB2. The diode 1725 (D4) is a catch diode to suppress inductive kick-back from the solenoid coil 515.

The following elements provide electrostatic discharge (ESD) protection: resistors 1730, 1735 and 1740, and capacitors 1745, 1750 and 1755. Preferably, the resistors 1730, 1735, and 1740 are sized at about 4.7 kilo-ohms, 1 kilo-ohms, and 1 kilo-ohms, respectively, while the capacitors 1745, 1750 and 1755 are each sized at about 0.01 microfarads. Additionally, the PTC device 1760 protects the invention against short circuits.

All circuits in FIGS. 14A, 14B, 14C, 14D, 14E, 14F are connected directly to the power supply 525 and there is no post-regulation. Typical idle current draw is less than about 30 micro-amperes. When the plunger 310 is drawn towards the adapter 315, as best shown in FIG. 4, current draw can rise to about 500 milli-amperes.

Figure 15:
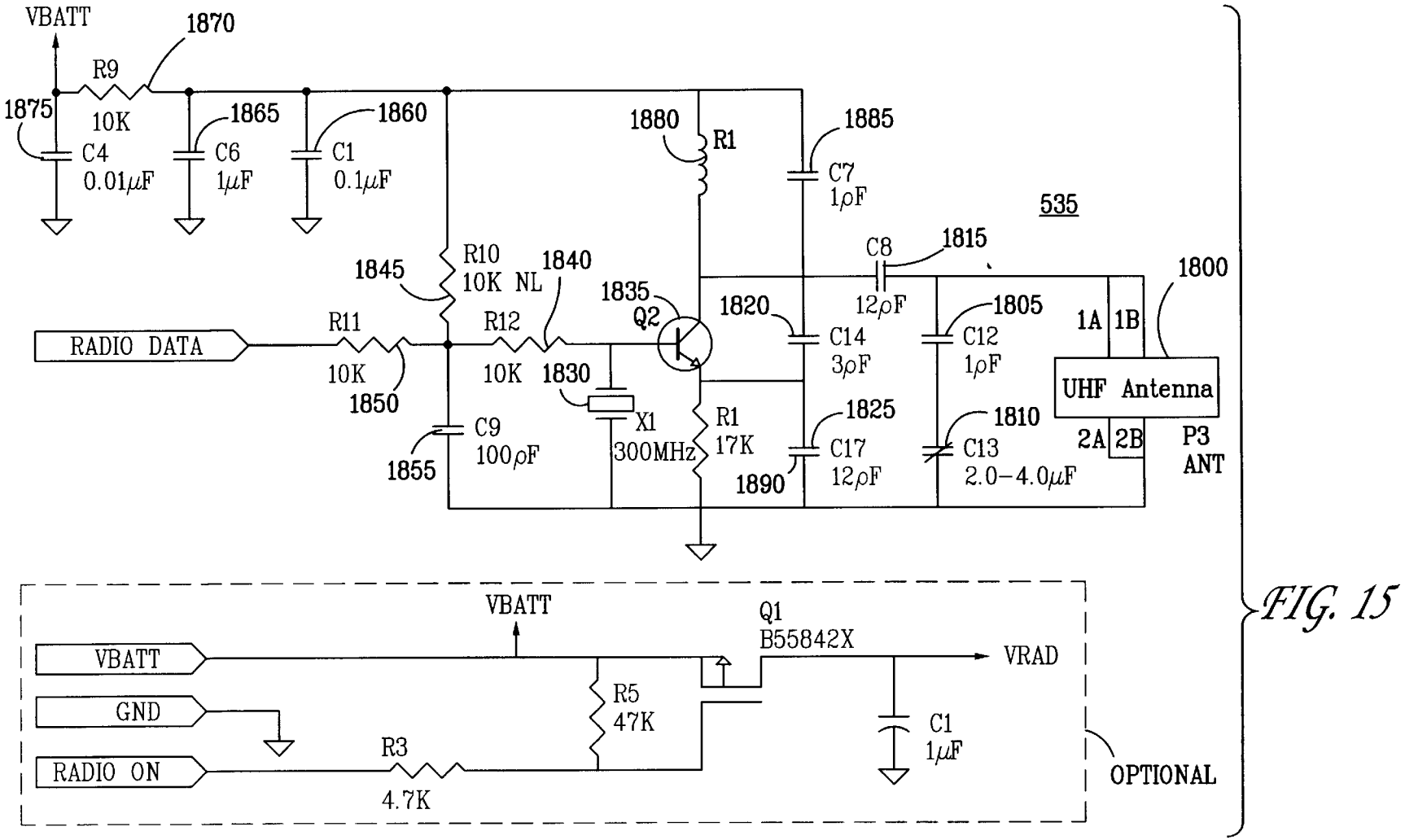
FIG. 15 is a schematic diagram of the transmitter of FIG. 5.

FIG. 15 is a schematic diagram of a preferred embodiment of the transmitter 535 in FIG. 5. The transmitter 535 is a conventional SAW-based transmitter which is designed for ON/OFF keying and utilizes a near-field antenna arrangement. The transmitter 535 includes loop antenna 1800 (P3), and capacitors 1805 (C12), 1810 (C13), 1815 (C8), 1820 (C14), and 1825 (C17) which are coupled to the loop antenna 1800. Preferably, the capacitors 1805, 1815, 1820, and 1825 are sized at about 1 picofarad (pF), 12 pF, 3 pF, and 12 pF, respectively. The variable capacitor 1810 can be set in the range from about 2.0 to about 6.0 pF. The transmitter 535 sends data packets 115 (see FIG. 1) to the receiver 120 (see FIG. 1) via high-frequency radio signals 115. The transmitter 535 transmits the radio signals at an FCC approved frequency via the loop antenna 1800. During normal operation, the transmitter 535 is unpowered. Data transmission is accomplished via ON-OFF keying with a bit time of about 1.0 ms. Each transmitter 535 unit contains a 16-bit serial number which is transmitted along with a 3-bit sequence code, 5-bit message, and 8-bit checksum. The transmitter 535 sends the data packet 115 (see FIG. 1) multiple times to insure that the receiver 120 (see FIG. 1) receives the data packet 115. The variable capacitor 1810 is adjusted to insure maximum power output by transmitter 535 within FCC guidelines.

The SAW resonator 1830 (X1) is coupled to the input terminal of the transistor 1835. A resistor 1840 is coupled to the input terminal of the transistor 1835, while the resistors 1845 and 1850 and the capacitor 1855 are coupled to the resistor 1840. Preferably, the resistors 1840, 1845, and 1850 are each sized at about 10 kilo-ohms, while the capacitor 1855 is sized at about 100 pF. The capacitors 1860 and 1865 and the resistor 1870 are coupled to the resistor 1845, while the capacitor 1875 is coupled to the resistor 1870. Preferably, the capacitors 1860, 1865, and 1875 are sized at about 0.1 microfarads, 1 microfarads, and 0.01 microfarads, respectively, while the resistor 1870 is sized at about 10 ohms. The inductor 1880, capacitor 1885, and resistor 1890 are also coupled to the terminals of the transistor 1835. Preferably, the capacitor 1885 is sized at about 1 picofarad, while the resistor 1890 is sized at about 100 ohms.

The SAW resonator 1830 controls the transmission frequency of the transmitter 535. By driving power to the resistor 1850, an oscillator is formed around the transistor 1835 and the SAW resonator 1830.

Figure 16:
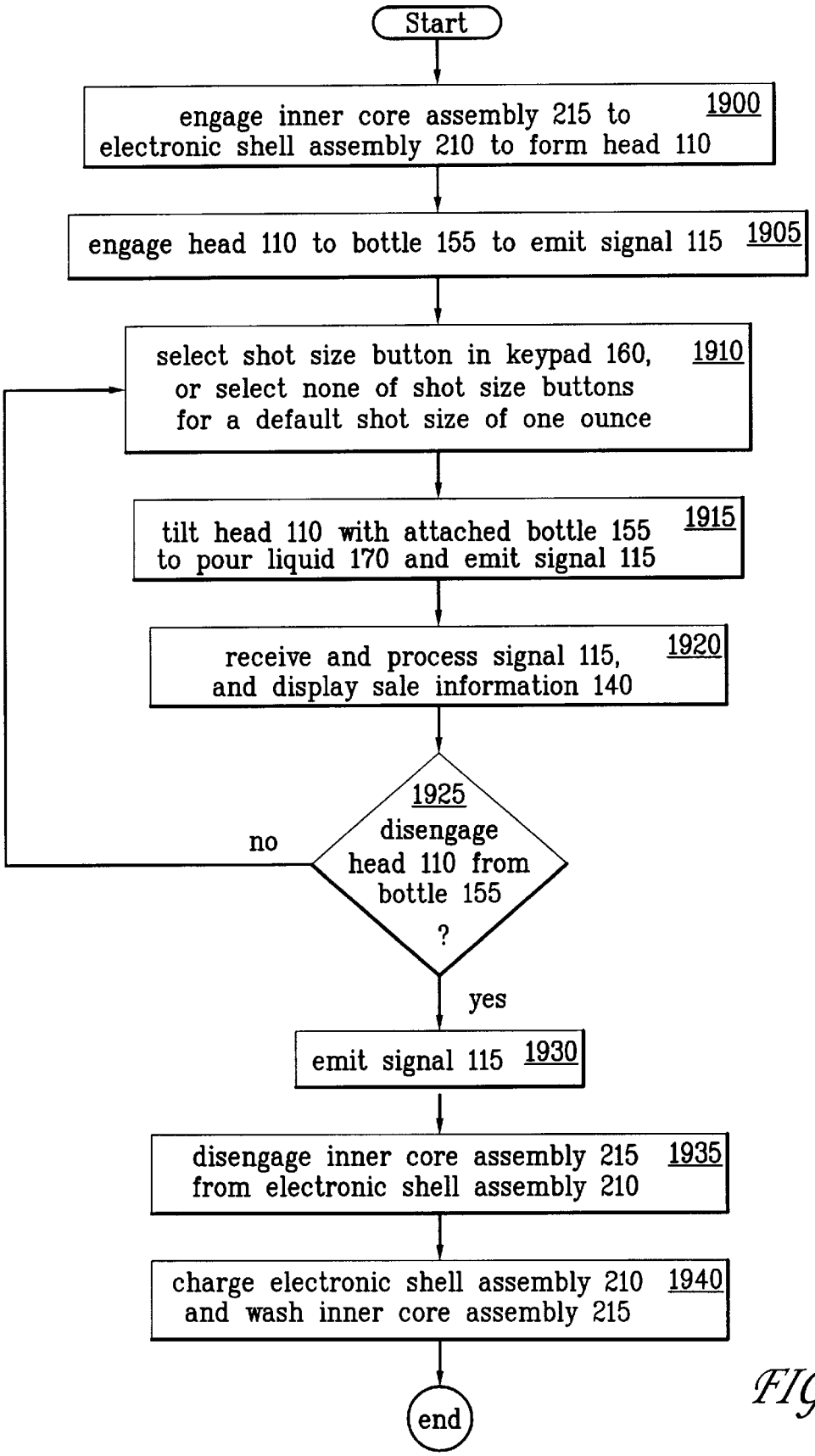
FIG. 16 is a flowchart illustrating a method of operation of the present invention.

FIG. 16 is a flowchart illustrating a method of operation of the present invention. In step 1900, the inner core assembly 215 is engaged to the electronic shell assembly 210 to form the head 110. In step 1905, the bartender engages the head 110 to a bottle 155. Upon engagement, the signal 115 is emitted and then received by the receiver 120 (see FIG. 1). In step 1910, the bartender may press one of the shot-size buttons 615, 620, 625, 630 (see FIG. 6) in the keypad 160 to pour a desired amount of liquid from the bottle 155. Alternatively, the bartender may select none of the shot-size buttons 615, 620, 625, 630 to pour a default shot size of one ounce. In step 1915, to pour the selected amount of liquid, the bartender tilts the head 110 with the attached bottle 155. The signal 115 is emitted and then received by the receiver 120 (see FIG. 1).

As shown in step 1920, the signal 115 is emitted and then received by the receiver 120 (see FIG. 1), and the computer 125 (see FIG. 1) processes the signal 115 into the point-of-sale information 140. The point-of-sale information 140 may be displayed in the screen 145 (see FIG. 1) or printed by printer 147 (see FIG. 1). The cash register 149 (see FIG. 1) may also receive the point-of-sale information 140.

In step 1925, the bartender may choose whether or not to disengage the head 110 from the bottle 155. If the bartender chooses not to disengage the head 110, then the bartender may repeat step 1910, during which a desired amount of liquid to be poured is selected. If the bartender chooses to disengage the head 110, then the signal 115 is emitted as shown in step 1930. By causing the signal 115 to emit upon disengagement of the head, this invention may detect any cheating or unauthorized pouring by the bartender. The signal 115 which is emitted in step 1930 is received by the receiver 120 (see FIG. 1).

In step 1935, the inner core assembly 215 may be disengaged from the electronic shell assembly 210. This disengagement permits the inner core assembly 215 to be washed or rinsed and the electronic shell assembly 210 to be charged, as shown in step 1940. When the electronic shell assembly 210 has been fully recharged and/or the inner core assembly 215 fully rinsed, the bartender can repeat step 1900 whereby the electronic shell assembly 210 is engaged with the inner core assembly 215. Alternatively, the bartender may repeat step 1900 by engaging the fully-recharged electronic shell assembly 210 to another inner core assembly 215. In another alternative, the bartender may repeat step 1900 by engaging the fully-rinsed inner core assembly 215 to another electronic shell assembly 210.

Thus, while the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

What is claimed is:

1. A system for controlling an amount of liquid poured from a liquid container comprising:

a spout configured for attachment to an opening of a liquid container and for controlling a desired amount of liquid poured from the liquid container, said spout further configured to emit signals containing activity information;

the spout further comprising:

an electronic shell for housing electronic components, the electronic components being operative to selectively allow or inhibit dispensing of the liquid, and to transmit the signals; and an inner core removably disposed within the electronic shell, and being separable therefrom, the inner core having a cavity through which the liquid may flow;

a receiver configured to receive said signals; and a computer coupled to said receiver, for processing said signals into text for viewing.

2. The system of claim 1 further comprising:

a second receiver for receiving said signals.

3. The system of claim 1 wherein said computer further comprises software for processing said signals into text.

4. The system of claim 3 wherein said text includes inventory information.

5. The system of claim 3 wherein said software allows said activity, information to be recorded.

6. The system of claim 1 further comprising a printer coupled to said computer, for displaying said text.

7. The system of claim 1 further comprising a cash register coupled to said computer, for indicating said text.

8. The system of claim 1 wherein said spout further comprises:

a solenoid coil disposed within the electronic shell for controlling the movement of a moveable plunger disposed within the cavity; wherein the inner core assembly is at least partially disposed within a volume defined interiorly of the solenoid coil.

9. The system of claim 8 wherein said electronic shell further comprises:

a microcontroller for controlling the flow of liquid from the liquid container and for controlling data transmission in the electronic shell assembly;

a tip switch coupled to the microcontroller, for detecting the position of the liquid container;

a sense switch coupled to the microcontroller, for detecting the presence of a liquid container attached to said spout; and a transmitter coupled to the microcontroller, for transmitting said signals.

10. The system of claim 8 wherein said electronic shell further comprises:

a comparator coupled to said microcontroller, for monitoring the supply voltage level.

11. The system of claim 9 wherein the plunger is conically shaped.

12. The system of claim 9 wherein said electronic shell further comprises:

a control mechanism controlled by said microcontroller, for attracting said plunger away from a plunger seat for a predetermined time until the desired amount of liquid has passed from the liquid container and through said cavity.

13. The system of claim 12 wherein said control mechanism comprises:

a solenoid coil for providing magnetic force to draw said plunger away from said plunger seat for a predetermined time until the desired amount of liquid has passed from the liquid container and through said conduit.

14. The system of claim 13 wherein said solenoid coil is provided power which is modulated at less than 100%.

15. The system of claim 14 wherein said power is modulated by software within said microcontroller.

16. The system of claim 8 further comprising a battery charger for charging said electronic shell.

17. The system of claim 1 wherein said signals are transmitted upon attachment of said spout to a liquid container.

18. The system of claim 1 wherein said signals are transmitted upon detachment of said spout from a liquid container.

19. The system of claim 1 wherein said signals are transmitted when a predetermined amount of liquid is poured from a liquid container attached to said spout.

20. A system for controlling the flow of liquid from a liquid container comprising:

an interface adapted for connection to an opening of a receptacle and for controlling the flow of liquid from said receptacle, said interface configured to transmit signals containing activity information;

the interface comprising a inner core detachably coupled to an outer electronic shell;

the inner core having a cavity that includes an inlet, an outlet, and a plunger biasly disposed against the outlet to prevent inadvertent or unauthorized flow of liquid through the inner core;

the outer electronic shell including electronic components for transmitting said signals; and a receiver for receiving said signals transmitted by said interface.

21. The system of claim 20 further comprising:

a data processing unit coupled to said receiver, for processing said signals into readable form.

22. The system of claim 21 wherein said data processing unit further comprises software for processing said signals into readable form.

23. The system of claim 20 further comprising:

a second receiver for receiving said signals transmitted by said interface.

24. The system of claim 20 wherein said plunger further comprises a conically shaped plunger biasly disposed against the outlet by a spring.

25. The system of claim 24 wherein said inner core further comprises a plunger seat disposed adjacent to the outlet for receiving the plunger such that the plunger is biased to create a seal at the plunger seat to thereby selectively prevent the liquid from passing through the outlet.

26. The system of claim 20 wherein said electronic shell further comprises:

a microcontroller for controlling the flow of liquid from the receptacle;

a tip switch coupled to the microcontroller, for detecting the position of the receptacle;

a sense switch coupled to the microcontroller, for detecting the presence of a receptacle attached to said interface; and a transmitter coupled to the microcontroller, for transmitting said signals.

27. The system of claim 26 wherein said electronic shell further comprises:

a control mechanism controlled by said microcontroller, for attracting said plunger away from said plunger seat for a predetermined time until the desired amount of liquid has passed from the receptacle and through said outlet.

28. The system of claim 27 wherein said control mechanism comprises:

a solenoid coil for providing magnetic force to draw said plunger away from said plunger seat for a predetermined time until the desired amount of liquid has passed from the receptacle and through said outlet.

29. The system of claim 28 wherein said solenoid coil is provided power which is modulated at less than 100%.

30. The system of claim 29 wherein said power is modulated by software within said microcontroller.

31. A method for controlling the flow of liquid poured from a liquid container comprising the steps of:

providing an inner core having a cavity through which the liquid may flow;

removably disposing the inner core within a volume defined by an electronic shell, the electronic shell having a transmitter for transmitting signals containing activity information and electronic components for selectively allowing or inhibiting the dispensing of liquid through the inner core;

dispensing liquid through the inner core cavity;

transmitting the signals containing activity information;

removing the inner core from within the volume defined by the electronic shell so that the inner core may be cleaned without damaging the transmitter or the electronic components.

32. The method of claim 31 wherein said activity information signal includes transaction information.

33. The method of claim 31 wherein said activity information includes inventory information.

34. The method of claim 31 wherein said predetermined activity includes pouring said amount of liquid from said liquid container.

35. A system for controlling the flow of liquid poured from a liquid container comprising:

means for determining an amount of liquid which is to be poured from a liquid container;

means for emitting activity information signal corresponding to a predetermined activity;

means for dispensing the amount of liquid which is to be poured from the liquid container, the means for dispensing being detachable from the means for determining and the means for emitting so that the means for dispensing may be cleaned without damaging the means for determining or the means for emitting;

means for remotely receiving the activity information signal; and means for processing the activity information signal into readable form.

36. A method for controlling liquid flow from a liquid container, comprising the steps of:

(a) engaging a spout to an opening of a liquid container to transmit a first signal and to control liquid flow;

(b) determining an amount of liquid which is to be poured from the liquid container;

(c) transmitting a second signal to a remote receiver after said amount of liquid has been poured from the liquid container; and (d) manipulating the second signal into readable form for viewing;

(f) periodically disassembling the spout into an outer shell that houses electronic components for performing the steps of determining and transmitting, and an inner valve core through which the liquid flows, such that the outer shell is available for recharging and the inner valve core is available for cleaning.

37. The method of claim 36 wherein said first signal indicates the engagement of said spout to said liquid container.

38. The method of claim 36 wherein said second signal indicates said amount of liquid poured from said liquid container.

39. The method of claim 36 further comprising the step of:

(e) disengaging said spout from the opening of the liquid container to transmit a third signal.

40. A system for controlling liquid flow from a liquid container comprising:

means for engaging an opening of a liquid container to transmit a first signal and to control liquid flow;

means for determining an amount of liquid which is to be poured from the liquid container;

means for transmitting a second signal to a remote receiver after said amount of liquid has been poured from the liquid container;

means for dispensing the amount of liquid, the means for dispensing being detachably coupled to the means for transmitting so that the means for dispensing may be cleaned without damaging the means for transmitting; and means for manipulating the second signal into readable form for viewing.

41. A system for controlling an amount of liquid poured from a liquid container comprising:

inner core means for permitting a predetermined amount of liquid to be dispensed therethrough;

outer electronic shell means for controlling operation of the inner core means;

the inner core means being positioned within the outer electronic shell means and being separable therefrom to permit the inner core means to be detached from the outer electronic shell means and cleaned while the outer electronic shell means is recharged; and means for emitting activity information signal corresponding to a predetermined activity, the means for emitting being disposed within the outer electronic shell.

* * * * *